US007904000B2

(12) United States Patent
Akamatsu

(10) Patent No.: US 7,904,000 B2
(45) Date of Patent: Mar. 8, 2011

(54) IMAGE FORMING APPARATUS WITH DECELERATION MEASURING SECTION

(75) Inventor: Hirotsugu Akamatsu, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 86 days.

(21) Appl. No.: 12/428,552

(22) Filed: Apr. 23, 2009

(65) Prior Publication Data

US 2009/0285601 A1 Nov. 19, 2009

(30) Foreign Application Priority Data

May 14, 2008 (JP) ..... 2008-127090

(51) Int. Cl.
*G03G 15/00* (2006.01)

(52) U.S. Cl. ..... 399/167

(58) Field of Classification Search ..... 399/301, 399/167; 347/116

See application file for complete search history.

(56) References Cited

U.S. PATENT DOCUMENTS

| | | | | |
|---|---|---|---|---|
| 7,215,907 | B2 * | 5/2007 | Fukuchi et al. | 399/167 |
| 2005/0271418 | A1 * | 12/2005 | Kojima | 399/167 |

FOREIGN PATENT DOCUMENTS

| | | |
|---|---|---|
| JP | 2005-266425 | 9/2005 |
| JP | 2007-17856 | 1/2007 |
| JP | 2007-334249 | 12/2007 |

* cited by examiner

*Primary Examiner* — Sophia S Chen

(74) *Attorney, Agent, or Firm* — Renner, Otto, Boisselle & Sklar, LLP

(57) ABSTRACT

An image forming apparatus including: a first and a second photoconductor groups constituted of one or more photoconductors respectively; a first and a second drive control sections for controlling the drive of the first and second photoconductor groups respectively to rotate the photoconductors thereof, and a deceleration measuring section for measuring respective degrees of deceleration when the first and second photoconductor groups rotate under their own inertias with a drive thereof being stopped, wherein the rotational phases of the first photoconductor group and the second photoconductor group are adjusted to be matched therebetween; and the first and second drive control sections determine a control pattern for decelerating so that a degree of deceleration to be applied at the stage of stopping drive of the first and second photoconductor groups become equal to or slower than the slowest one among the degrees of deceleration being measured.

11 Claims, 16 Drawing Sheets

State in which phases are matched

State in which C photoconductor advances by σ

State in which C photoconductor delays by σ

IMAGE FORMING APPARATUS WITH DECELERATION MEASURING SECTION

CROSS-REFERENCE TO RELATED APPLICATION

This application is related to Japanese Patent Application No. 2008-127090 filed on May 14, 2008, whose priority is claimed and the disclosure of which is incorporated by reference in its entirety.

BACKGROUND OF THE INVENTION

1. Field of the Invention

The present invention relates to an image forming apparatus having plural photoconductors.

2. Description of the Related Art

There has been known an image forming apparatus, i.e., a so-called tandem type image forming apparatus, in which plural toner images are formed by means of plural photoconductors, each corresponding to each toner image, with an electrophotographic process, and these toner images are superimposed. In a tandem type image forming apparatus that forms a full-color image, toner images of respective color components, such as yellow ), magenta (M), cyan (C), and black (K), are formed by means of different photoconductors, and each of the toner images is superimposed (see, for example, Japanese Unexamined Patent Application No. 2005-266425).

In the tandem type image forming apparatus, it is necessary to drive the plural photoconductors, each corresponding to each toner image, and an image forming section for forming toner images onto the corresponding photoconductors. The number of components can be reduced by driving the photoconductors of Y, M, and C, which are simultaneously driven, and the corresponding image forming sections (including a developing unit) with a single motor in order to reduce the number of components in a drive section so as to downsize the apparatus. On the other hand, as for the black color, the K photoconductor and the K image forming section (including a K developing unit) are driven with a motor different from the motor used for the YMC, since the sections involved with the black color solely form an image during the formation of a monochromatic image. A stepping motor can be used, for example, as a motor for driving the photoconductors of the respective colors and the corresponding image forming sections. However, it is preferable to use a DC motor, which has a driving force per volume greater than that of the stepping motor, in order to drive a great number of loads, such as the loads for the YMC, with a single motor.

In a structure in which each of the photoconductors of the respective colors and the corresponding image forming sections are independently driven, there may be a case in which a capacity of the K developing unit is set to be greater than the capacities of the developing units for the other colors in order to make a frequency of an exchange of the K developing unit equal to that of the developing units for the other colors, since the K developing unit is more frequently used for the monochromatic printing than the other colors. In this case, a DC motor having a great driving force is preferable. A DC motor may sometimes be used for the other colors in order to share a control circuit and a control program with K. However, the problems described below arise when the DC motor is used for the drive.

Specifically, each of the photoconductors has a very small eccentricity due to a processing precision or assembling precision of components. This eccentricity produces a speed irregularity, which agrees with the rotating cycle, in a peripheral speed. A banding (periodic occurrence of coarse portions and fine portions) is produced due to the speed irregularity. When the high-density portions (fine portions) and the low-density portions (coarse portions) in the respective toner images are different in case where the toner images having the banding are superimposed, a color misregistration occurs, and this color misregistration is noticeable. In view of this, in order to match the high-density portions and the low-density portions in the respective toner images, the photoconductors are assembled with the rotational phase thereof adjusted. Further, the drive of each of the photoconductors is controlled so as to keep the adjusted rotational phase.

The control of the rotational phase is easy, if a stepping motor is used. However, when a DC motor is used, an increase curve of the speed of each of the YMC photoconductors and an increase curve of the speed of the K photoconductor during a period from when the respective photoconductors are started to when they reach a predetermined process speed might not be matched. This causes either the YMC photoconductors or the K photoconductor to rotate faster. Accordingly, a misregistration occurs in the rotational phases of the YMC photoconductors and the K photoconductor.

This will be described in more detail. FIG. 16 is a waveform chart illustrating the change in the speed when a photoconductor drum is stopped by means of a DC motor used for a drive source in a conventional image forming apparatus. During the image formation, the photoconductor drum rotates with a constant speed Vf. In order to stop the photoconductor drum, the supply of electric current to a motor is discontinued to allow the photoconductor drum to naturally stop, or the motor is operated as an electromagnetic brake to cause a forced brake, by which the photoconductor drum is stopped. This corresponds to a time td in FIG. 16. When the photoconductor drum is naturally stopped, the photoconductor drum rotates for a while by inertia due to inertial load even after the supply of electric current to the motor is discontinued.

Compared to a deceleration-change characteristic curve (A1K) of the motor that drives the K photoconductor, a deceleration-change characteristic curve (A1CL) of the motor that drives the Y, M, and C photoconductors has a gentle slope. This is because the motor driving the K photoconductor has a reduced load compared to the motor driving the Y, M, and C photoconductors. When the deceleration-change characteristics of both motors are different from each other, the misregistration in the phases occurs. When the photoconductors are stopped by a forced brake, a time when the photoconductors rotate with inertia is shorter compared to a case in which the photoconductors naturally stop. Specifically, a slope of each of the deceleration-change characteristic curves is sharper than the slope thereof in the case of natural stopping. Even so, each of the photoconductor drums rotates with inertia for a while. In this case, the slope of the deceleration-change characteristic curve (A2CL) of the motor driving the Y, M, and C photoconductors is gentler than the slope of the deceleration-change characteristic curve (A2K) of the motor driving the K photoconductor. In the case of the forced brake, the misregistration in the phases occurs due to a difference in the deceleration-change characteristics.

In order to prevent the misregistration in the rotational phases during the deceleration, there has been proposed an apparatus in which each of the photoconductors is driven to rotate for a predetermined time with a second revolution, which is slower than a first revolution that is the revolution during the image formation, and then, each of the photoconductors is stopped, when each of the photoconductors is to be stopped (see, for example, Japanese Unexamined Patent Application No. 2005-266425).

However, even when the stopping control described in Japanese Unexamined Patent Application No. 2005-266425 is executed, the misregistration in the rotational phases becomes non-negligible even by executing the stopping control described above, when a difference in the loads of the motors is great. This is unfavorable from a viewpoint of preventing the color misregistration.

SUMMARY OF THE INVENTION

The present invention is accomplished in view of the above-mentioned circumstance, and aims to provide an image forming apparatus that can decelerate and stop each of the photoconductors with the rotational phases of the photoconductors correctly agreed to each other.

The present invention provides an image forming apparatus including: a first photoconductor group constituted of one or more photoconductors used for forming a mono-color image; a second photoconductor group constituted of one or more photoconductors used for forming a full-color image with the first photoconductor group together; a first drive section for driving the first photoconductor group to rotate the photoconductor(s) thereof; a second drive section for driving the second photoconductor group to rotate the photoconductor(s) thereof; a first drive control section for controlling the first drive section; a second drive control section for controlling the second drive section, and a deceleration measuring section for measuring respective degrees of deceleration when the first and second photoconductor groups rotate under their own inertias with a drive thereof being stopped, wherein each photoconductor constituting the first and second photoconductor groups is engaged to the corresponding drive section thereto with rotational phases being matched with one another; the rotational phases of the first photoconductor group and the second photoconductor group are adjusted to be matched therebetween; and the first and second drive control sections determine a control pattern for decelerating both the first and second drive sections so that a degree of deceleration to be applied at a time when the first and second photoconductor groups stop rotating becomes equal to or slower than the slowest one among the degrees of deceleration measured by the deceleration measuring section.

The image forming apparatus according to the present invention includes first and the second drive control sections, and a deceleration measuring section for measuring respective degrees of deceleration when the first and second photoconductor groups rotate under their own inertias with a drive thereof being stopped, wherein, the first and second drive control sections determine a control pattern for decelerating both the first and second drive sections so that a degree of deceleration to be applied at the stage of stopping drive of the first and second photoconductor groups become equal to or slower than the slowest one among the degrees of deceleration measured by the deceleration measuring section. Accordingly, when a photoconductor driven by the first drive section and a photoconductor driven by a second drive section are stopped in an image forming apparatus having plural photoconductors, each forming an image that is to be superimposed, the misregistration in the rotational phases generated during when the photoconductors are stopped can be suppressed.

DETAILED DESCRIPTION OF THE PREFERRED EMBODIMENTS

Figure 1:
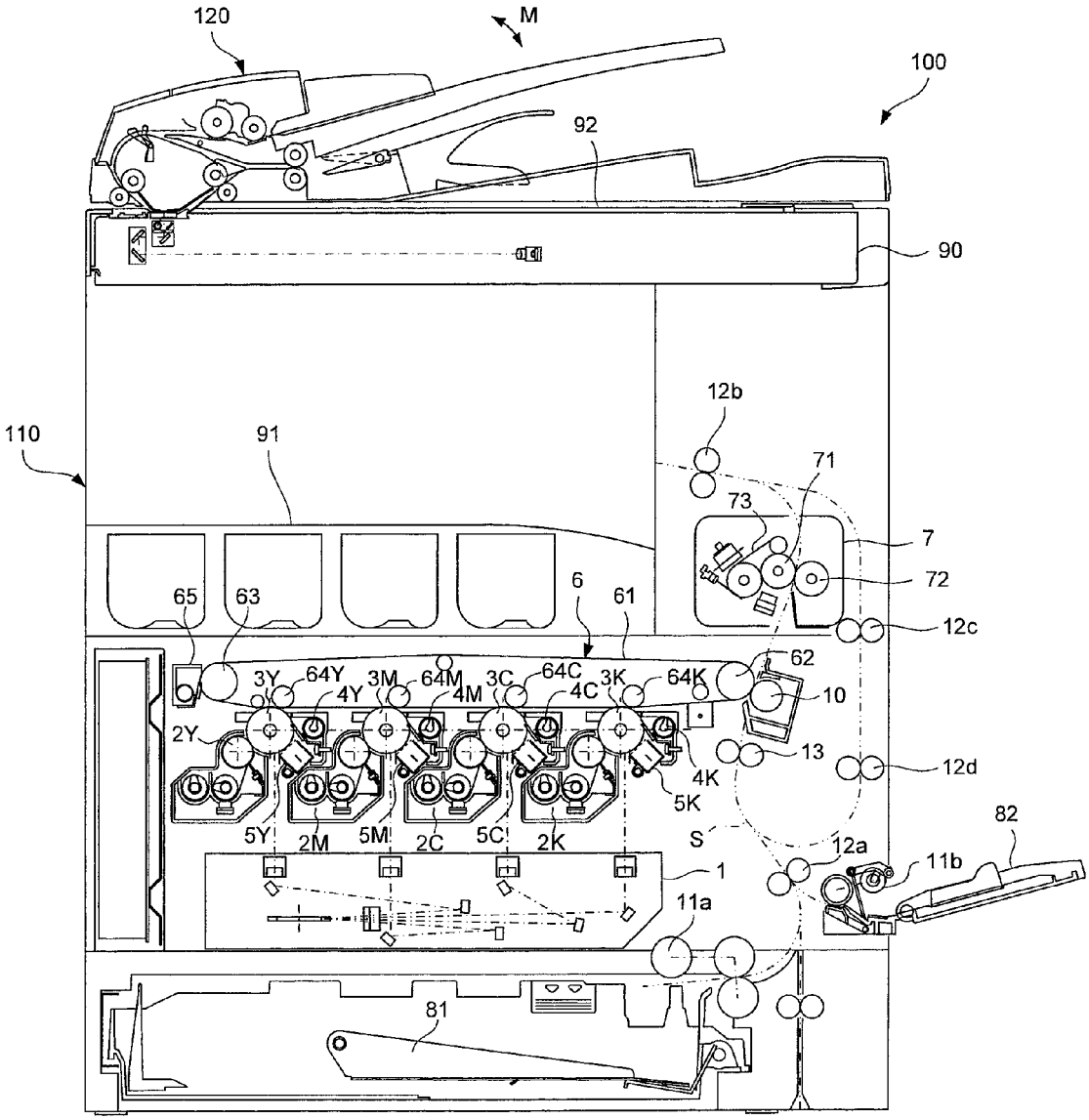
FIG. 1 is an explanatory view illustrating an outline of an image forming apparatus to which the present invention is applied.

In the present invention, a monochromatic image is formed by using one or more color components, and formed by a color component smaller than that used for a full-color image. When the monochromatic image is formed by plural color components, a color phase of the image is substantially uniform in each region.

The first and second drive sections drive the photoconductors. The specific embodiment thereof includes, for example, a mechanism for transmitting a drive from a drive source by means of a DC motor, a gear, a timing belt, or the like serving as the drive source.

The deceleration measuring section measures the degree of the deceleration of each load with the loads being operated with inertia. The specific embodiments thereof include, for example, a speed detecting circuit of a motor, and a CPU that determines the revolution of the motor based on an output signal from the speed detecting circuit. In an embodiment described later, the speed detecting circuit corresponds to a frequency generator (FG) incorporated in the motor, and a logic circuit that detects the revolution of the motor based on a signal from the FG.

The first drive control section controls the start, stop and drive speed of the photoconductor driven by the first drive section. The second drive control section controls the start, stop and drive speed of the photoconductor driven by the second drive section. The specific embodiment thereof includes, for example, a control circuit of a motor and a CPU that gives an instruction to the control circuit.

The image forming apparatus further includes known mechanisms such as an image forming section, a superimposing section, a sheet feeding tray that stores print sheets, a second transfer section that transfers a toner image onto an intermediate transfer belt to the print sheet fed from the sheet feeding tray, a fixing section that fixes the toner image transferred onto the print sheet to the print sheet, etc.

The image forming section is arranged for forming the toner image onto a surface of the photoconductor. The image forming section includes each of a station involved with a charging, exposure, development, cleaning, and discharge, those of which are steps in an electrophotographic process.

The superimposing section transfers and superimposes the toner images formed on the respective photoconductors. The specific embodiment thereof includes, for example, an endless intermediate transfer belt that moves as successively being contact with the respective photoconductors, and a drive mechanism that drives the intermediate transfer belt.

Preferable embodiments of the present invention will be described below.

The image forming apparatus of the present invention may further include a phase detecting section for detecting the rotational phases of the first photoconductor group and the second photoconductor group; and a rotational phase correcting section for determining whether the matched rotational phases of the first and second photoconductor groups are maintained or not based on the results of the detections of the phase detecting section, and corrects the rotational phases of the first and/or the second photoconductor groups/group according to the results of the determination of the rotational phase correcting section, wherein the rotational phase correcting section may detect whether the matched rotational phases are maintained or not at a predetermined timing, and allow the first and/or the second drive control sections/section to correct the rotational phase of the first and/or the second photoconductor groups/group when the rotational phase correcting section determines that the matched rotational phases are not maintained. With this configuration, when the rotational phases of the photoconductors are shifted from each other with the repeated operations of the start, rotation, and stop of each photoconductor, and the misregistration amount exceeds from an adjusted state to deviate from the predetermined allowable range, the misregistration is detected and the first and/or the second drive control sections are caused to correct the rotational phases, whereby the rotational phases can be returned to a state after the adjustment, at least can be returned to the value within the allowable range. Further, according to the present invention, the misregistration in the rotational phases caused upon starting the photoconductors can be prevented, so that the frequency of the correction can be reduced compared to the conventional case.

The rotational phase correcting section may correct the rotational phase after the deceleration measuring section measures the degrees of deceleration and before a subsequent full-color image is formed. With this configuration, a next full-color image formation is started after the misregistration in the rotational phases after the measurement is corrected, whereby the color misregistration is unnoticeable.

The rotational phase correcting section may ignore the results of the detections of the phase detecting section in the period from startup of the first and second photoconductor groups to a time of their reaching the speed for image-formation and may determine whether the matched rotational phases are maintained or not based on the results of the detections of the phase detecting sections after the reaching. With this configuration, the rotational phases can be detected with a state in which the photoconductors are driven with the speed for the image formation and the rotational phases of the photoconductors are stable. Therefore, the correct determination can be made.

The deceleration measuring section may start to measure the degrees of deceleration at a time, as a trigger, when the rotational phase correcting section determines that the rotational phases are not maintained. With this configuration, it is determined that the deceleration control is not appropriate since the phase misregistration is detected during the steady rotation, and a deceleration pattern can be optimized by remeasuring the deceleration.

According to the present invention, when the deceleration measuring section finds out beforehand which one of the first and second drive sections has slower degree of the deceleration, the deceleration measuring section may measure the slower one of the deceleration, and does not measure the other. With this configuration, the photoconductors are not unnecessarily rotated to cause deterioration or abrasion of the photoconductors.

The first drive control section may control so that a rotational phase of the first photoconductor group at a time when the first photoconductor group starts rotating matches with a rotational phase thereof at a time when it stops rotating, when a mono-color image is formed. With this configuration, it can be controlled such that, even after the mono-color image is formed, a state in which the rotational phases of the respective photoconductors are adjusted can be maintained.

The first photoconductor group may be constituted of a single photoconductor, while the second photoconductor group may be constituted of a plurality of photoconductors. With this configuration, the plural photoconductors are driven by a common drive section. Accordingly, the number of components of the drive section can be reduced, whereby the apparatus can be downsized and the cost can be reduced. Furthermore, the present invention can prevent the misregistration in the rotational phases of the respective photoconductors upon starting the photoconductors.

Each of the photoconductors may be used for forming a toner image of a different color component, the first photoconductor group may be used for forming a black toner image, and the second photoconductor group may be constituted of three photoconductors used for forming a yellow toner image, a cyan toner image, and a magenta toner image, respectively. With this configuration, the drive section is respectively provided to the YMC photoconductors that are simultaneously driven during the formation of a color image and the K photoconductor that is solely driven during the formation of a monochromatic image. Therefore, only the photoconductor used for forming a monochromatic image is solely driven, and the photoconductors that are simultaneously driven can be driven with the common drive section.

The unnecessary sections can be stopped during the formation of a monochromatic image, whereby unnecessary power consumption can be suppressed, and the deterioration of consumable components can be suppressed. Moreover, the present invention can prevent the misregistration in the rotational phases caused when the photoconductors are started.

Alternatively, as a different embodiment, a second group photoconductors may be any one of a yellow photoconductor, a cyan photoconductor, or a magenta photoconductor. Specifically, in the structure in which the yellow photoconductor, the cyan photoconductor, and the magenta photoconductor are driven by the independent drive sections, any one of the photoconductors corresponds to the second group photoconductor of this invention, and the black photoconductor corresponds to the first group photoconductor.

Each of the first and second drive sections may include a DC motor for driving the corresponding photoconductor group, respectively. With this configuration, the photoconductors can efficiently be driven by means of a DC motor that has a driving force per volume greater than that of a stepping motor. Further, the present invention can prevent the misregistration in the rotational phases caused when the photoconductors are started.

The image forming apparatus according to the present invention may further includes: a plurality of image forming sections for forming toner images on the photoconductors, each of the image forming sections forming an toner image on different photoconductors, wherein the first drive section drives image forming section(s) which forms/form the toner image(s) on the photoconductor(s) of the first photoconductor group and the second drive section may drive image forming section(s) which forms/form the toner image(s) on the photoconductor(s) of the second photoconductor group, and each of the image forming sections may include at least a developing section. With this configuration, the image forming section, particularly a developing section having a heavy load, is driven by the common drive section. Accordingly, the number of components of the drive section can be reduced, whereby the apparatus can be downsized and the cost can be reduced. Furthermore, the present invention can prevent the misregistration in the rotational phases of the respective photoconductors upon starting the photoconductors.

The various preferable embodiments described above can be combined.

The present invention will be described in detail below with reference to the drawings. It should be understood that the following description is illustrative of the invention in all aspects, but not limitative of the invention.

<Overall Structure of Image Forming Apparatus>

The overall structure of an image forming apparatus according to the present invention will be described first. Particularly, a photoconductor, an image forming section, and a superimposing section will be described.

FIG. 1 is an explanatory view schematically illustrating an image forming apparatus to which the present invention is applied. As illustrated in FIG. 1, an image forming apparatus 100 prints a multi-color or mono-color image onto a predetermined sheet (print sheet) in accordance with image data externally transmitted. The image forming apparatus 100 includes a body 110, an automatic document feeder 120, and a document reading section 90.

A document platen 92 made of a transparent glass on which a document is placed is mounted at an upper portion of the body 110. The document placed onto the document platen 92 is scanned and read by the document reading section 90. The automatic document feeder 120 transports the document onto the document platen 92. The automatic document feeder 120 is configured so as to be pivotable in a direction of an arrow M, whereby a document can manually be placed thereon by opening the document platen 92.

The body 110 includes an exposure unit 1, developing devices [developing units] 2 (2Y, 2M, 2C, 2K), photoconductor drums 3 (3Y, 3M, 3C, 3K), cleaner units 4 (4Y, 4M, 4C, 4K), chargers 5 (5Y, 5M, 5C, 5K), an intermediate transfer belt unit 6, a fuser unit 7, a sheet feeding tray 81, a manual sheet-feeding tray 82, a sheet exit tray 91, and the like.

The image date handled by the image forming apparatus corresponds to a color image using colors of black (K), cyan (C), magenta (M), and yellow (Y). Therefore, four developing devices 2, four photoconductor drums 3, four charging devices 5, and four cleaner units 4 are provided so as to form four types of latent images corresponding to four colors. Each of these devices is set respectively to black, cyan, magenta, and yellow, whereby four image stations are formed. Any one of alphabets of Y, M, C, and K is attached at an end of the numerals in the figure.

The photoconductor drums 3 for the respective colors correspond to the photoconductor in the present invention. The charging devices 5, the developing devices 2 and the cleaner units 4 for the respective colors correspond to the image forming section in the present invention.

Each of the charging devices 5 is means for uniformly charging a surface of each of the photoconductor drums 3 with a predetermined potential. The illustrated charger type charging device, a contact roller type charging device or a brush type charging device may be employed.

The exposure unit 1 is configured as a laser scanning unit (LSU) including a laser emitting section and a reflection mirror. The LSU includes laser light-emitting elements, each of which emits a laser beam of Y, M, C, and K independently, a polygon mirror that reflects the laser beam emitted from each of the laser emitting elements to deflect the same, and an optical element (lens or mirror) for guiding the laser beam reflected by the polygon mirror to the photoconductor drums 3 of the respective colors. Instead of the LSU, the exposure unit 1 may be configured as an optical writing head having light-emitting elements such as EL or LED arranged in an array.

A peripheral surface of each of the photoconductor drums 3 charged by each of the charging devices 5 is scanned and exposed by the exposure unit 1 with patterns of the respective colors according to the inputted image data. With this exposure, an electrostatic latent image in accordance with the image data of each color is formed on the surface of each of the photoconductor drums 3. Each of the developing devices 2 makes the electrostatic latent image formed on the peripheral surface of each of the photoconductor drums 3 visible with toner. Each of the toner images, which are made visible, is transferred onto the later-described intermediate transfer belt 61 and superimposed with one another. Each of the cleaner units 4 removes and collects residual toner on the surface of each of the photoconductor drums 3 after the development and the image transfer.

The intermediate transfer belt unit 6 is arranged above the photoconductor drums 3. The intermediate transfer belt unit 6 includes an intermediate transfer belt 61, an intermediate-transfer-belt drive roller 62, an intermediate-transfer-belt driven roller 63, intermediate transfer rollers 64 (64Y, 64M, 64C, 64K), and an intermediate-transfer-belt cleaning unit 65. An intermediate transfer bias voltage is applied to each of the intermediate transfer rollers 64 for transferring the toner image onto the photoconductor drum 3.

The intermediate transfer belt unit corresponds to the superimposing section in the present invention.

The intermediate transfer belt 61 is driven by the intermediate-transfer-belt drive roller 62 during the image formation, and is brought into contact with the photoconductor drums 3Y, 3M, 3C, and 3K, which simultaneously rotate, successively along a rotating direction. The toner images of the respective color components formed on the peripheral surfaces of the photoconductor drums 3 are superimposed and transferred, one by one, on the intermediate transfer belt 61. As a result, a color toner image (multi-color toner image) is transferred onto the intermediate transfer belt 61. The intermediate transfer belt 61 is an endless belt using a resinous film having conductivity with a thickness of about 100 to 150 μm, for example. The toner image that is superimposed and transferred onto the intermediate transfer belt 61 moves to a second transfer section where the intermediate-transfer-belt drive roller 62 and the transfer roller 10 are brought into contact with each other, and then, is transferred onto a print sheet, which is fed from the sheet feeding tray, at the second transfer section. A transfer bias voltage is applied to the transfer roller 10 for transferring the toner to the sheet.

The intermediate-transfer-belt cleaning unit 65 having a cleaning blade is provided for removing and collecting residual toner on a surface of the intermediate transfer belt 61 after the toner image is transferred at the second transfer section.

The sheet feeding tray 81 is provided below the exposure unit 1. The sheet feeding tray 81 stores sheets (print sheets) used for the image formation. The print sheet can be fed from the manual sheet feeding tray 82. The sheet fed from the sheet feeding tray 81 and the manual sheet feeding tray 82 passes through a sheet transporting path S having substantially a vertical shape to be discharged onto the sheet exit tray 91 provided at the upper portion of the body 110 through the transfer roller 10 and the fuser unit 7. Pickup rollers 11*a*, 11*b*, a transport roller 12*a*, a registration roller 13, the transfer roller 10, the fuser unit 7, and the transport roller 12*b* are arranged on a path from the sheet feeding tray 81 and the manual sheet feeding tray 82 to the sheet exit tray 91 through the sheet transporting path S. Transport rollers 12*c* and 12*d* are arranged on a reverse path for a duplex printing that is parallel with the sheet transporting path S.

The pickup roller 11*a* picks up the sheet from the sheet feeding tray 81 one by one, and supplies the sheet to the sheet transporting path S. Similarly, the pickup roller 11*b* picks up the sheet from the manual sheet feeding tray 82 one by one, and supplies the sheet to the sheet transporting path S. The registration roller 13 temporarily stops the sheet, which is transported through the sheet transporting path S, with the leading end thereof being in contact with the roller. Then, the registration roller 13 transports the sheet at a timing when the toner images formed on the photoconductor drums 3 and a position of the sheet are synchronized, and allows the sheet to pass through the transfer roller 10.

The fuser unit 7 includes a heat roller 71 and a pressure roller 72. The heat roller 71 and the pressure roller 72 transport the sheet transported from the transfer roller 10 as nipping the sheet. A temperature detector is arranged on a surface of the heat roller 71. Further, an external heating belt 73 for externally heating the heat roller 71 is provided. A control section, not shown, for controlling the operation of the image forming apparatus 100 controls a heater provided to heat the external heating belt 73 based on a signal from the temperature detector, in order to control the surface of the heat roller 71 to be a predetermined temperature. When the print sheet passes through the fuser unit 7, the multi-color toner image transferred onto the sheet is fused, mixed, and pressed to be fixed onto the sheet through an application of heat and pressure from the heat roller 71 and the pressure roller 72.

<Structure of drive section and drive control section>

Next, a drive section and a drive control section for driving the photoconductor drums 3 of the respective colors and the developing devices 2 of the respective colors in the image forming apparatus 110 will be described.

Figure 2:
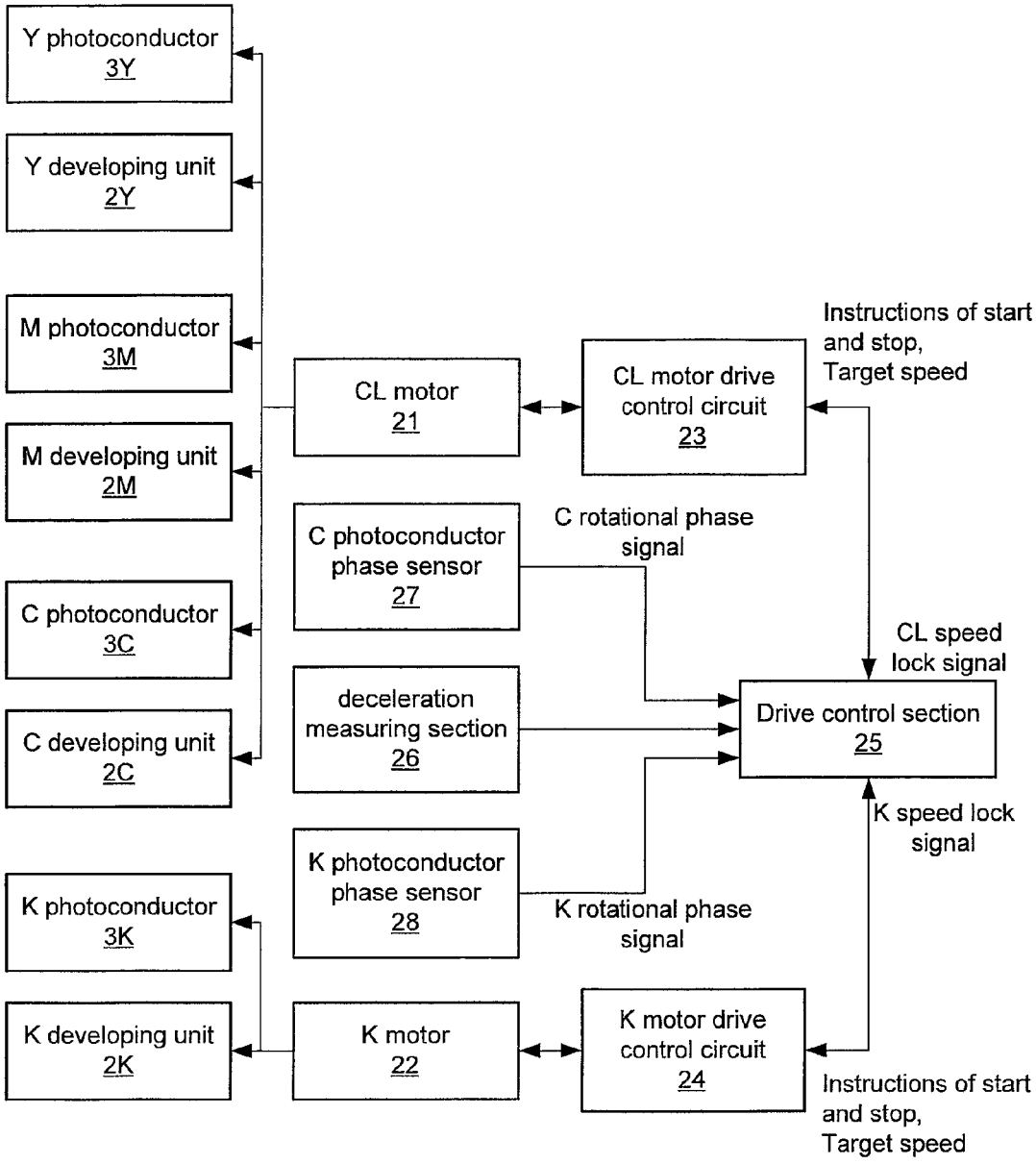
FIG. 2 is a block diagram illustrating a configuration of a drive section and a drive control section according to an embodiment of the present invention.

FIG. 2 is a block diagram illustrating the drive section and the drive control section according to an embodiment of the present invention. In FIG. 2, a CL motor 21 is a DC motor that drives the color photoconductors 3Y, 3M, and 3C and the color developing devices 2Y, 2M, and 2C. A K motor 22 is a DC motor that drives the black photoconductor 3K and the black developing device 2K.

The CL motor drive control circuit 23 controls the start, stop, and drive speed of the CL motor 21. The CL motor drive control circuit 23 is a servo control circuit that controls to agree the drive speed of the CL motor 21 with the target speed instructed from the drive control section 25. A K motor drive control circuit 24 controls the start, stop, and drive speed of a K motor 22. The K motor drive control circuit 24 is a servo control circuit that controls to agree the drive speed of the K motor 22 with the target speed instructed from the drive control section 25.

The drive control section 25 gives an instruction of start/stop of the CL motor 21 to the CL motor drive control circuit 23. During the image formation, the drive control section 25 gives an instruction to the CL motor drive control circuit 23 to drive the CL motor 21 with a predetermined process speed (a drive speed for the image formation). The drive control section 25 also gives an instruction of start/stop of the K motor 22 to the K motor drive control circuit 24. During the image formation, the drive control section 25 gives an instruction to the K motor drive control circuit 24 to drive the K motor 22 with the process speed.

The functions of the CL motor drive control circuit 23 and the drive control section 25 that gives an instruction to the CL motor drive control circuit 23 correspond to the first drive control section in the present invention. The functions of the K motor drive control circuit 24 and the drive control section 25 that gives an instruction to the K motor drive control circuit 24 correspond to the second drive control section in the present invention.

The deceleration measuring section 26 discontinues a supply of an electric current to the CL motor 21 and the K motor 22 during the rotation of each photoconductor, and measures the deceleration-change characteristic of each photoconductor with each photoconductor being operated with inertia.

A C photoconductor phase sensor 27 detects the rotational phases of the photoconductor drums 3Y, 3M, and 3C. A K photoconductor phase sensor 28 detects the rotational phase of the photoconductor drum 3K.

Figure 3:
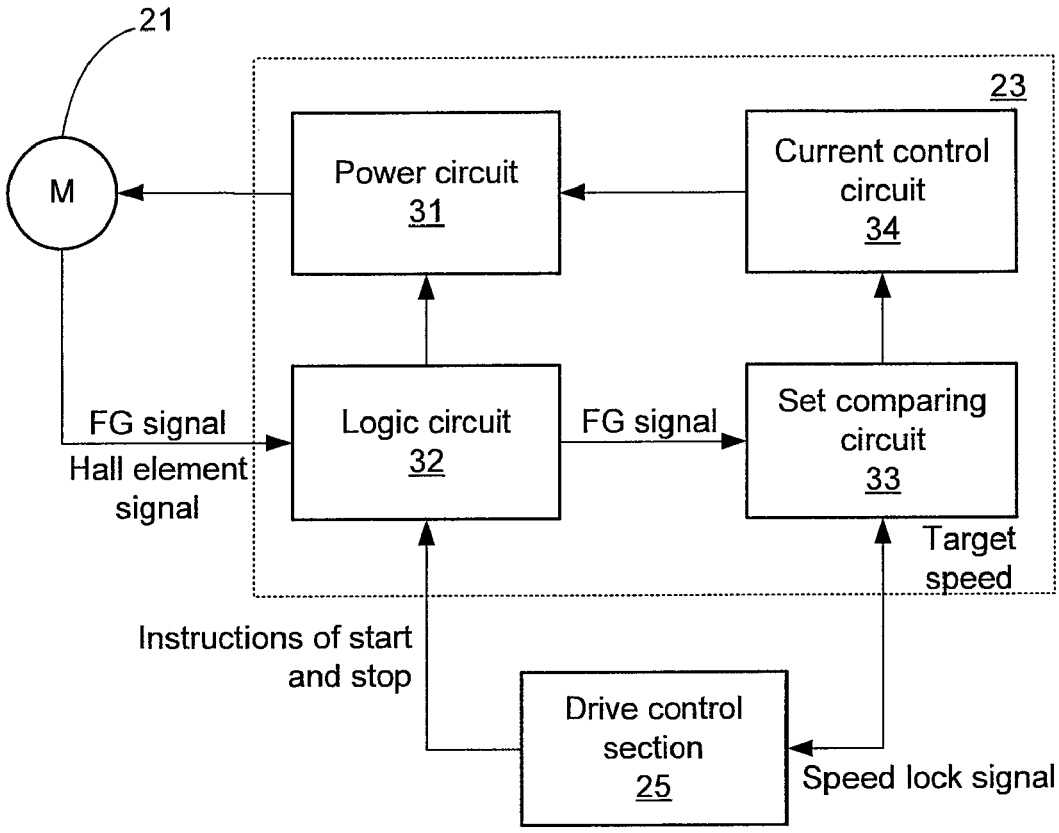
FIG. 3 is a block diagram illustrating a detailed configuration of a CL motor drive control circuit 23 shown in FIG. 2.

FIG. 3 is a block diagram illustrating a detailed configuration of the CL motor drive control circuit 23 shown in FIG. 2. As illustrated in FIG. 3, the CL motor drive control circuit 23 includes a power circuit 31, a logic circuit 32, a set comparing circuit 33, and a current control circuit 34. The CL motor in the present embodiment is a three-phase DC brushless motor.

The power circuit 31 is a bridge circuit that controls the current flowing through the winding of the motor. The power circuit 31 includes six switching transistors, i.e., two for one phase.

The logic circuit 32 receives a signal from a hall element arranged to the CL motor 21 in order to detect a rotating position of the rotor of the CL motor 21, and determines the order of the excitation of a motor winding, i.e., a pattern of on/off (switching) and a switching timing of the switching transistors in the power circuit 31. The logic circuit 32 also receives the instruction of the start and stop from the CL motor drive control circuit 23. It controls the switching of each of the transistors in accordance with the instruction. The logic circuit 32 also has a function of detecting the rotating speed of the CL motor 21. The CL motor 21 has incorporated therein a frequency generator (FG) for detecting the rotating speed. The logic circuit 32 detects the rotating speed based on a signal (FG signal) from the frequency generator.

The set comparing circuit 33 compares the target speed instructed from the drive control section and the FG signal indicating the rotating speed of the CL motor 21. Specifically, the set comparing circuit 33 compares whether the rotating speed of the CL motor 21 is faster than the target rotating speed or not. When the rotating speed of the CL motor 21 is higher than the target speed, the set comparing circuit 33 gives an instruction to the current control circuit 34 to reduce the input to the CL motor 21. When the rotating speed of the CL motor 21 is lower than the target speed, the set comparing circuit 33 gives an instruction to the current control circuit 34 to increase the input to the CL motor 21. When the rotating speed of the CL motor 21 agrees with the instructed target speed, the set comparing circuit 33 outputs a speed lock signal to the drive control section 25. The drive control section recognizes that the CL motor 21 rotates with the target speed from the speed lock signal.

The current control circuit 34 receives the instruction from the set comparing circuit 33, and controls the current flowing through the winding of the CL motor 21 by the power circuit 31.

The K motor drive control circuit 24 has the configuration same as that of the CL motor drive control circuit 23.

Next, a configuration of the drive mechanism that transmits the drive to the photoconductor drums 3Y, 3M, 3C, and 3K, which are loads, from the CL motor 21 and the K motor 22 serving as the drive source will be described. The drive mechanism constitutes the drive section in the present invention together with the motor serving as the drive source. The photoconductor-drum drive gears 41Y, 41M, 41C, and 41K belong to the photoconductors, since they rotate integral with the photoconductor drums 3Y, 3M, 3C, and 3K.

Figure 4:
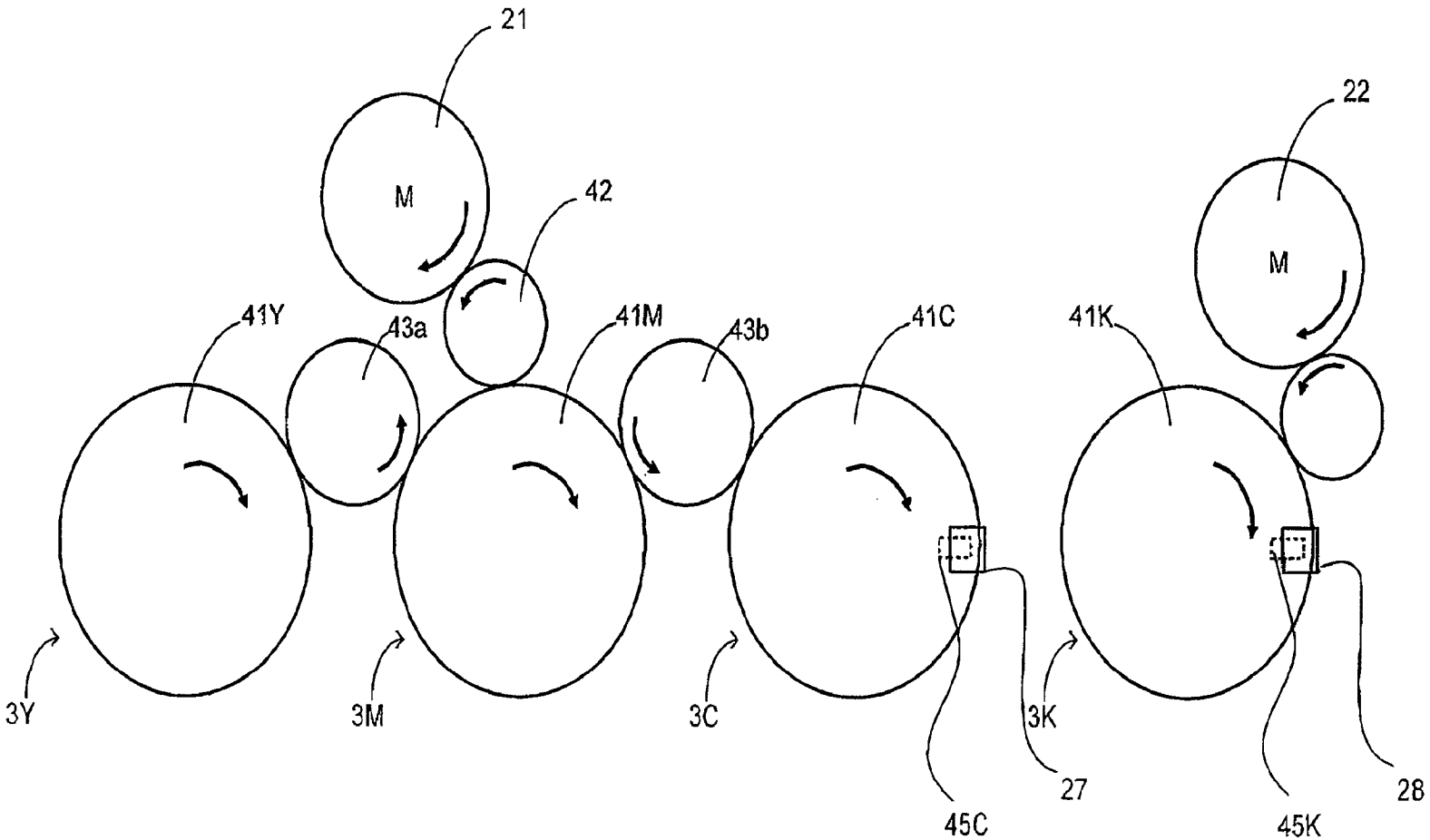
FIG. 4 is an explanatory view illustrating a configuration of a drive mechanism according to an embodiment of the present invention.

FIG. 4 is an explanatory view illustrating the configuration of the drive mechanism according to an embodiment of the present invention. In FIG. 4, a first end portion of each of the photoconductors 3 along the rotating direction is connected, through a coupling, to a rotational axis of each of drum drive gears 41Y, 41M, 41C, and 41K, which are arranged at the body 110 through a coupling. The drum drive gears 41Y, 41M, and 41C transmit a driving force to the photoconductor drum 3M from the drive gear fixed to the output shaft of the CL motor 21 through an input gear 42 and an idle gear. Further, the driving force is transmitted to the photoconductor drum drive gear 41Y from the photoconductor drum drive gear 41M through an idle gear 43*a*, and the driving force is transmitted to the photoconductor drum drive gear 41C from the photoconductor drum drive gear 41M through an idle gear 43*b*.

The C photoconductor phase sensor 27 is a photo interrupter type sensor for detecting the rotational phase of the photoconductor drum 3C. The photoconductor-drum drive gear 41C is provided with a projecting portion 45C at a position corresponding to the C photoconductor phase sensor 27. The projecting portion 45 C shields light of the C photoconductor phase sensor 27 per one rotation. In response to this, the C photoconductor phase sensor 27 outputs a C rotational phase signal. The K photoconductor phase sensor 28 is a photo interrupter type sensor for detecting the rotational phase of the photoconductor drum 3K. The photoconductor-drum drive gear 41K is provided with a projecting portion 45K at a position corresponding to the K photoconductor phase sensor 28. The projecting portion 45 K shields light of the K photoconductor phase sensor 28 per one rotation. In response to this, the K photoconductor phase sensor 28 outputs a K rotational phase signal.

In the present embodiment, the photoconductor drums 3Y, 3M and 3C are driven as coupled with one another with gears, so that the rotational phases are not misregistered during the drive. The eccentricity of each of the photoconductor-drum drive gears 41Y, 41M, and 41C greatly affects a banding in the toner image. However, the rotational phases of the gears are adjusted when the apparatus is shipped from a factory. Therefore, the rotational phase of the photoconductor drum 3C is detected as the representative of three photoconductor drums 3Y, 3M, and 3C. Then, the rotational phase is corrected between the photoconductor drum 3C and the photoconductor drum 3K. According to the present embodiment, the rotational phases of the photoconductor drums correspond to the rotational phases of the photoconductor-drum drive gears 41Y, 41M, and 41C.

Figure 11:
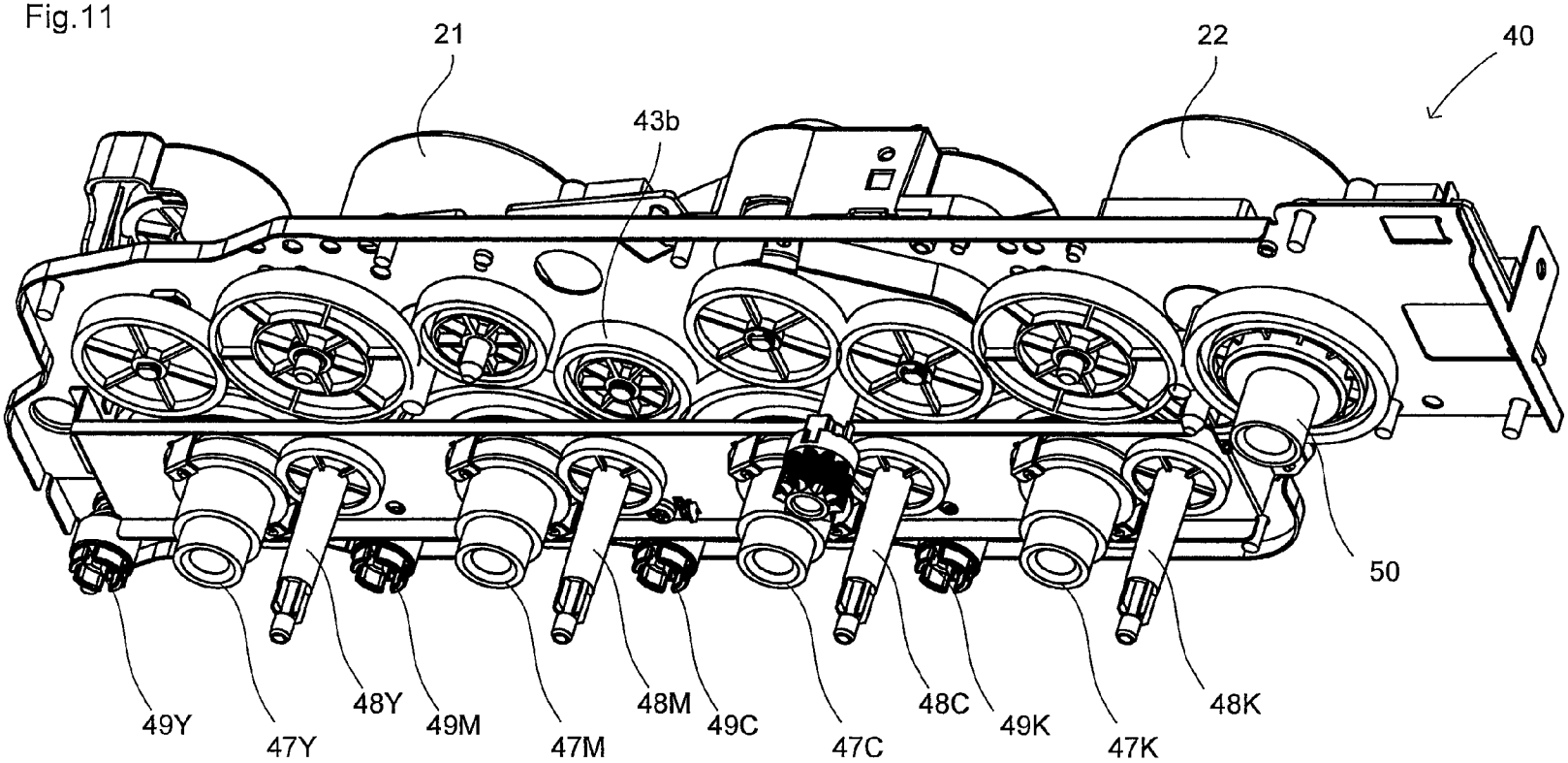
FIG. 11 is a perspective view illustrating a structure of a drive unit that is the drive mechanism shown in FIG. 4 formed into a unit.
Figure 12:
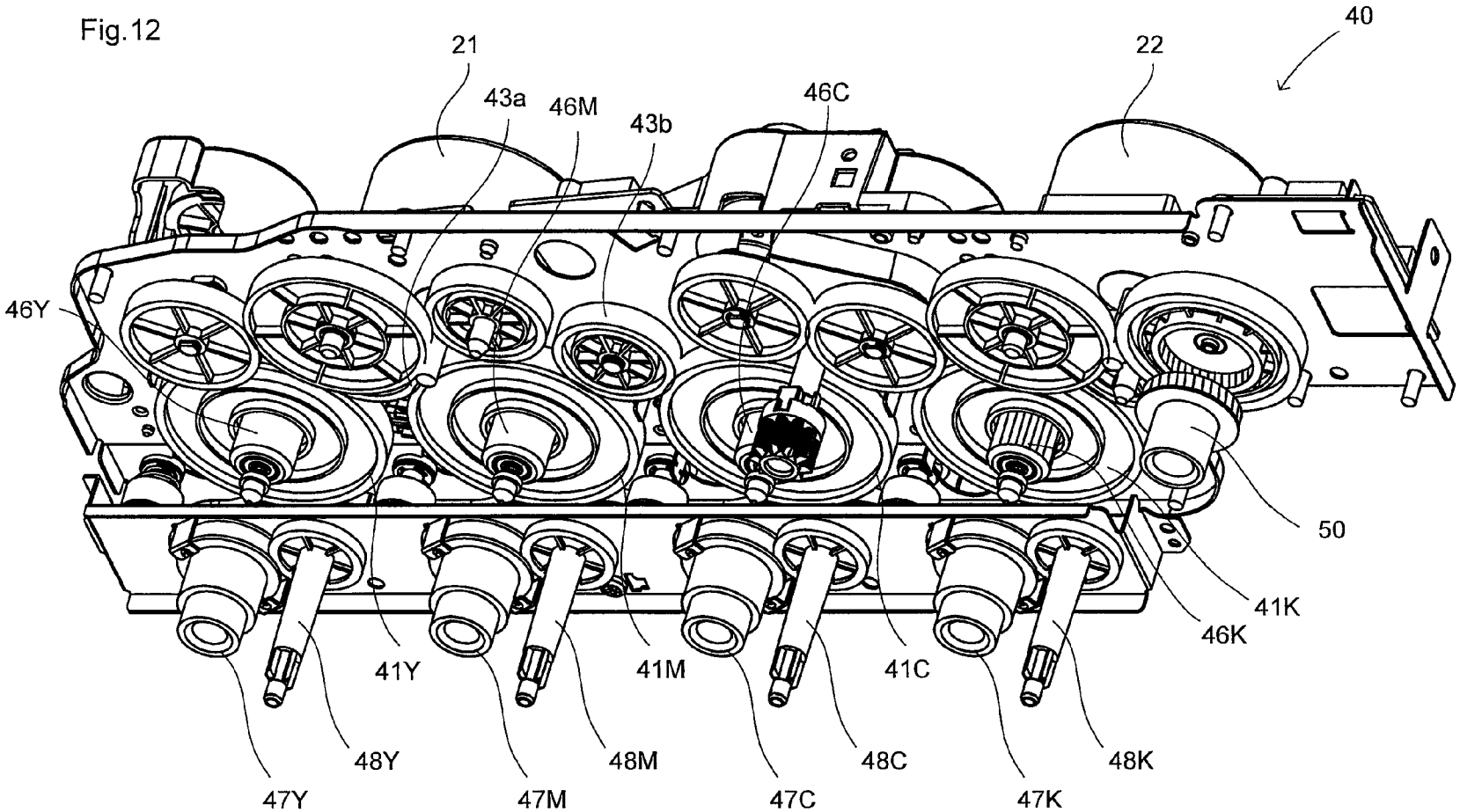
FIG. 12 is an explanatory view illustrating a state in which each coupling is drawn in a near side in order to allow a user to see a photoconductor-drum drive gear in the drive unit shown in FIG. 11.

FIG. 11 is a perspective view illustrating a configuration of a drive unit in which the drive mechanism shown in FIG. 4 is made into a unit. FIG. 12 illustrates a state in which the couplings are drawn in the near side in order to allow a user to see the photoconductor-drum drive gears in the drive unit shown in FIG. 11. A photoconductor-drum drive shaft 46 is mounted at the center of each of the YMCK photoconductor-drum drive gears 41. A gear is formed at an outer peripheral surface at a leading end of the photoconductor-drum drive gear 46. A first end of each of the photoconductor-drum drive couplings 47 is fitted so as to cover the gear at the leading end. A gear is formed at an inner periphery of each of the photoconductor-drum drive couplings 47, which gear is lightly meshed with the gear at the leading end of the corresponding photoconductor-drum drive shaft 46, whereby the rotational drive of the photoconductor-drum drive shaft 46 is transmitted to the photoconductor-drum drive coupling 47. A second end of each of the photoconductor-drum drive couplings 47 is connected to the corresponding photoconductor drum 3.

A photoconductor-drum drive gear 54 is arranged at the first end of each of the photoconductor drums 3. The photoconductor drum 3 is made into a process unit 53 including the cleaner unit 4 and the charging device 5.

Figure 13:
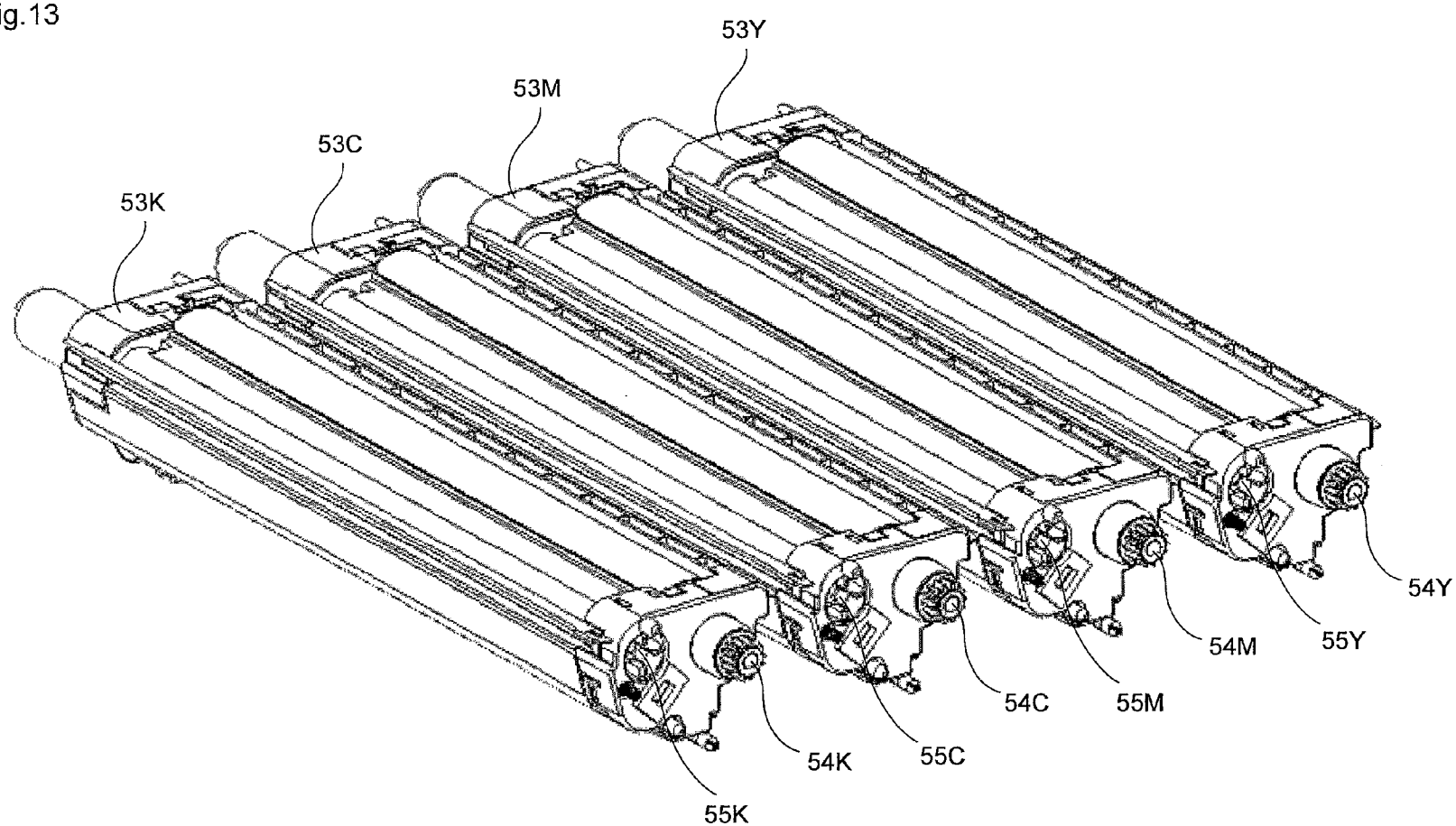
FIG. 13 is a perspective view illustrating a state in which each of process units of YMCK is arranged so as to correspond to the drive unit in an embodiment of the present invention.
Figure 14:
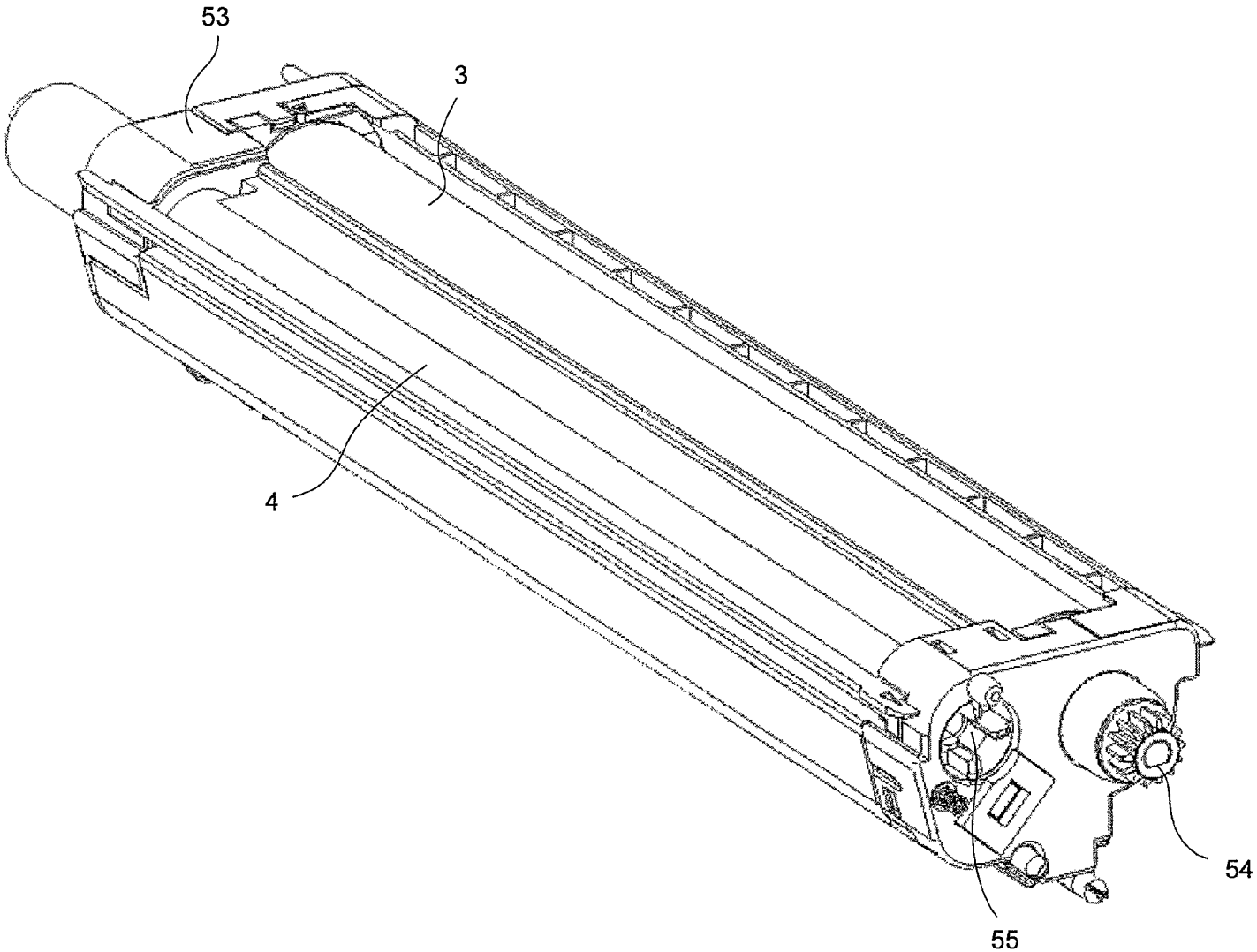
FIG. 14 is a perspective view illustrating an appearance of one of the process units shown in FIG. 13.

FIG. 13 is a perspective view illustrating a state in which each of the YMCK process units 53Y, 53M, 53C, and 53Y are arranged so as to correspond to the drive units 40. FIG. 14 is a perspective view illustrating an appearance of a single process unit. When each of the process units 53 is mounted to the body 110, each of the photoconductor-drum driven gears 54 is meshed with the gear formed on the inner periphery of each of the photoconductor-drum drive couplings 47. The rotational drive of each of the photoconductor-drum drive couplings 47 is transmitted to the photoconductor drums 3 via the photoconductor-drum driven gears 54.

The drive unit 40 also includes a cleaner drive coupling 48 that transmits drive to the cleaner unit 4, a developing drive coupling 49 that transmits drive to the developing device 2, and a transfer drive coupling 50 that transmits drive to the transfer roller 10. A cleaner driven coupling 55 that is engaged with the cleaner drive coupling 48 is provided to the process unit 53. The rotational drive transmitted to the cleaner driven coupling 55 rotates a waste toner transport screw provided in the cleaner unit 4.

Figure 7:
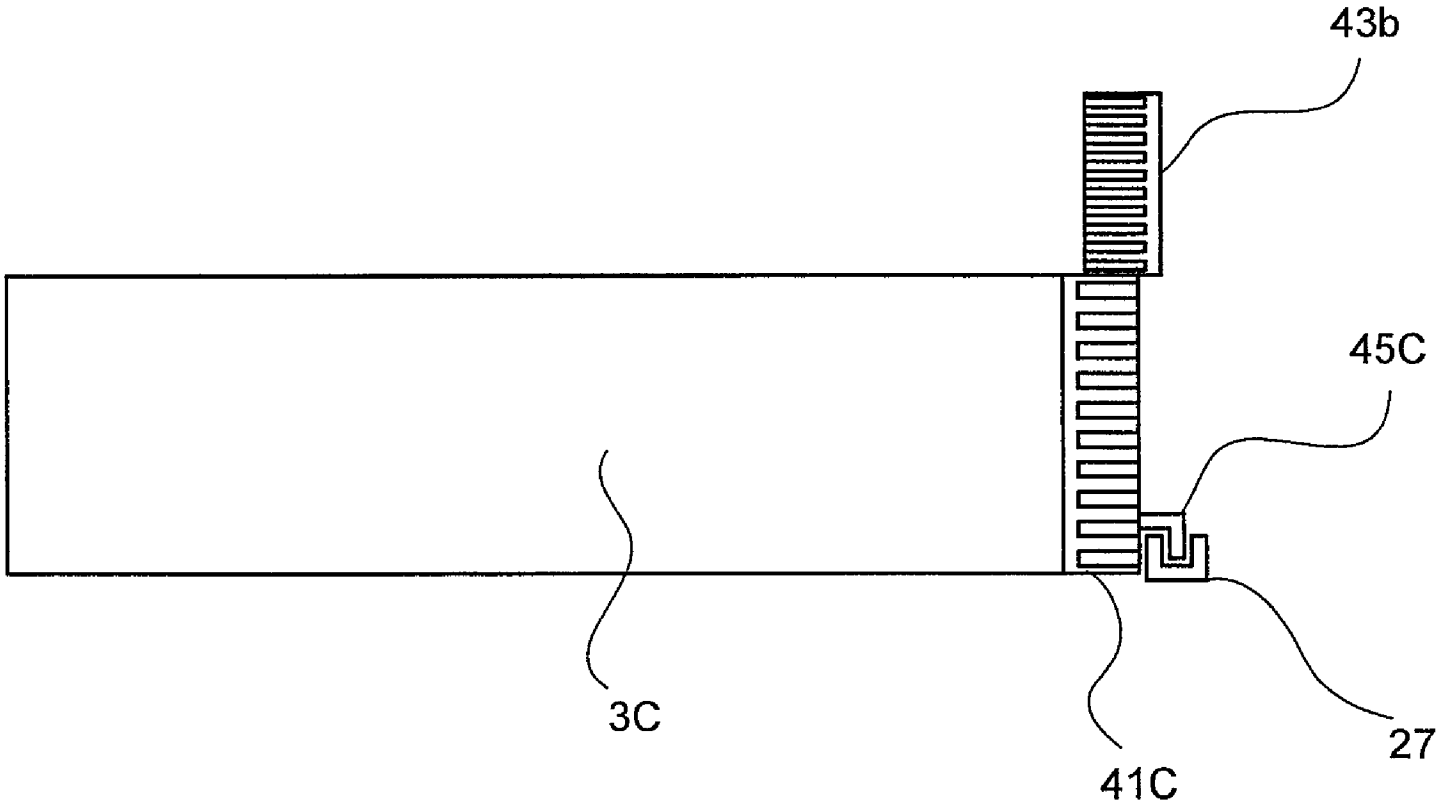
FIG. 7 is an explanatory view illustrating a configuration involved with a detection of a rotational phase of a photoconductor drum according to an embodiment of the present invention.

As illustrated in FIG. 7 described later, the drive mechanism may be configured as described below as a different embodiment. Specifically, each of drum drive gears 41 is fitted to the first end of each of the photoconductor drums 3 in an axial direction, and it is engaged with an input gear and an idle gear with the photoconductor drums 3 mounted to the body in order to transmit the driving force from the drive source. The photoconductor drums 3 for the respective colors are exchangeable components. However, since the drum drive gears 41 for the respective colors are exchanged with the photoconductor drums 3 for the respective colors in this embodiment, the rotational phase of each of the photoconductor drums 3 has to be adjusted after the exchange.

If the photoconductor drums 3Y, 3M, 3C, and 3K are driven by respective independent drive sources, and a photoconductor rotational phase sensor is provided for the respective colors in the configuration described above, the rotational phase of each of the photoconductor drums is detected after they are mounted, and the rotational phases thereof can be adjusted.

Since the control section autonomously executes a procedure described below, the rotational phases of the photoconductor drums 3 after the exchange can be adjusted without troubling a user. After the photoconductor drums 3 are exchanged, the control section forms a pattern for adjusting the rotation, and transfers the formed pattern on the intermediate transfer belt 61. A reflection-type photo sensor used for the detection is arranged so as to be opposite to the intermediate transfer belt 61.

Figures 15A, 15B:
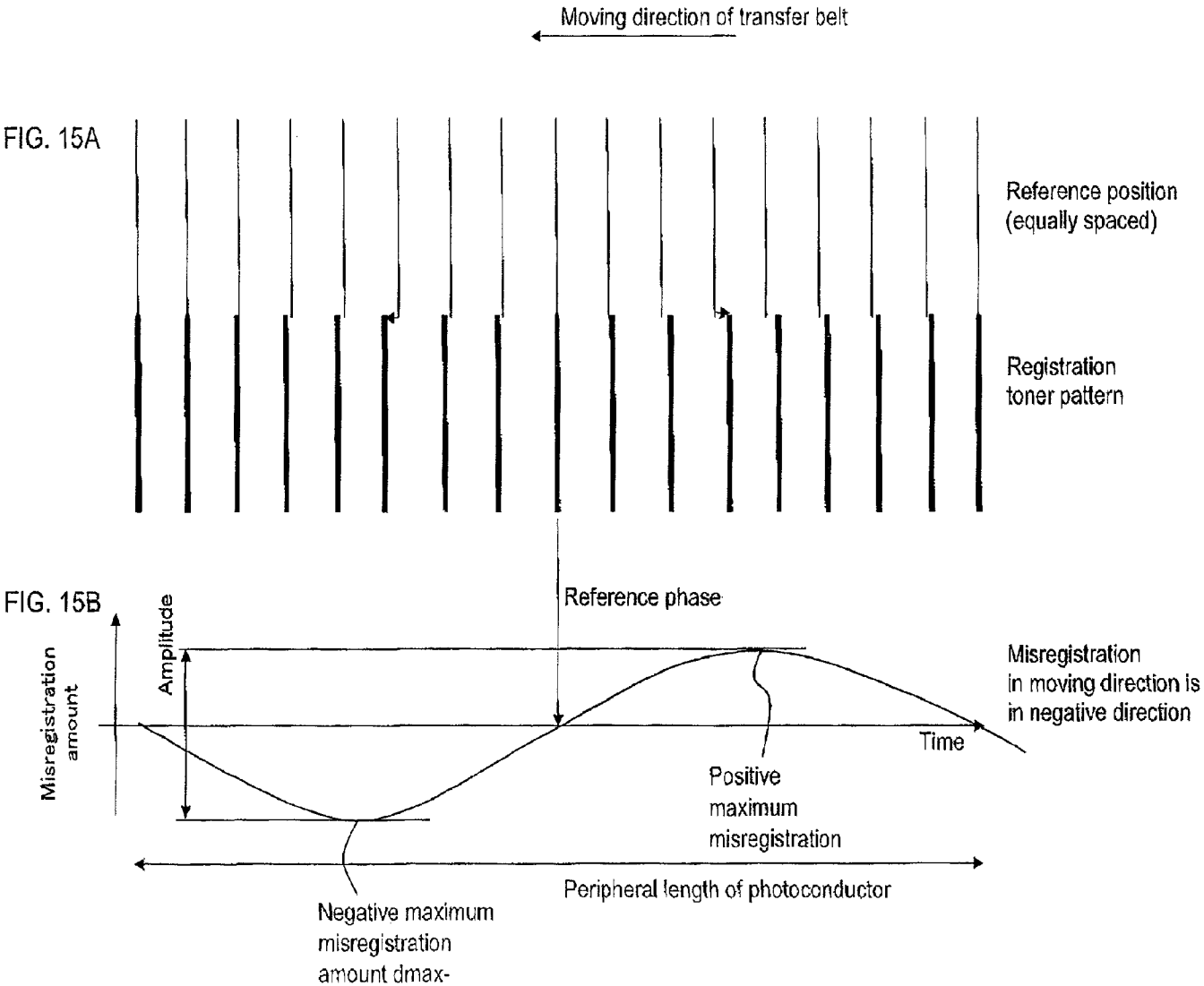
FIGS. 15A and 15B are explanatory views illustrating a pattern for adjusting the rotation in an embodiment of the present invention.

FIGS. 15A and 15B are explanatory views illustrating the pattern for adjusting the rotation. As shown in FIG. 15A, the pattern includes plural parallel lines that are orthogonal to an advancing direction of the intermediate transfer belt 61. An interval between the lines and the number of the lines in the pattern are set in such a manner that a period from when a first line passes through the photo sensor to when a last line passes through the photo sensor becomes substantially equal to the rotational cycle of the photoconductor drum 3. For example, the number of the lines is 17.

The control section allows the photo sensor to detect the pattern transferred onto the intermediate transfer belt 61, and compares a detection timing of each line with each of reference timings so as to acquire a delay time or advance time of each line. When the acquired delay time or the advance time is plotted with respect to the time, the waveform having a sine wave caused by the eccentricity of the photoconductor drum 3 is ideally obtained (see FIG. 15B).

The control section determines a line corresponding to the maximum delay time dmax− and a line corresponding to the maximum advance time dmax+, and determines a line closest to the middle of the respective lines as a reference phase line. This process is performed for the respective colors of Y, M, C, and K.

After the reference phase lines for the respective colors are determined, the control section determines the misregistration amount of the other reference phase lines (the reference phase lines of Y, M, and C) from the reference phase line of the reference color (e.g., K). The control section corrects the rotational phases of the photoconductor drums 3Y, 3M, and 3C based on the determined misregistration amount. The rotational phases are corrected when the photoconductor drums 3 are stopped. The correction of the rotational phase will be described in detail below.

<Speed Control by Drive Control Section>

Figure 5:
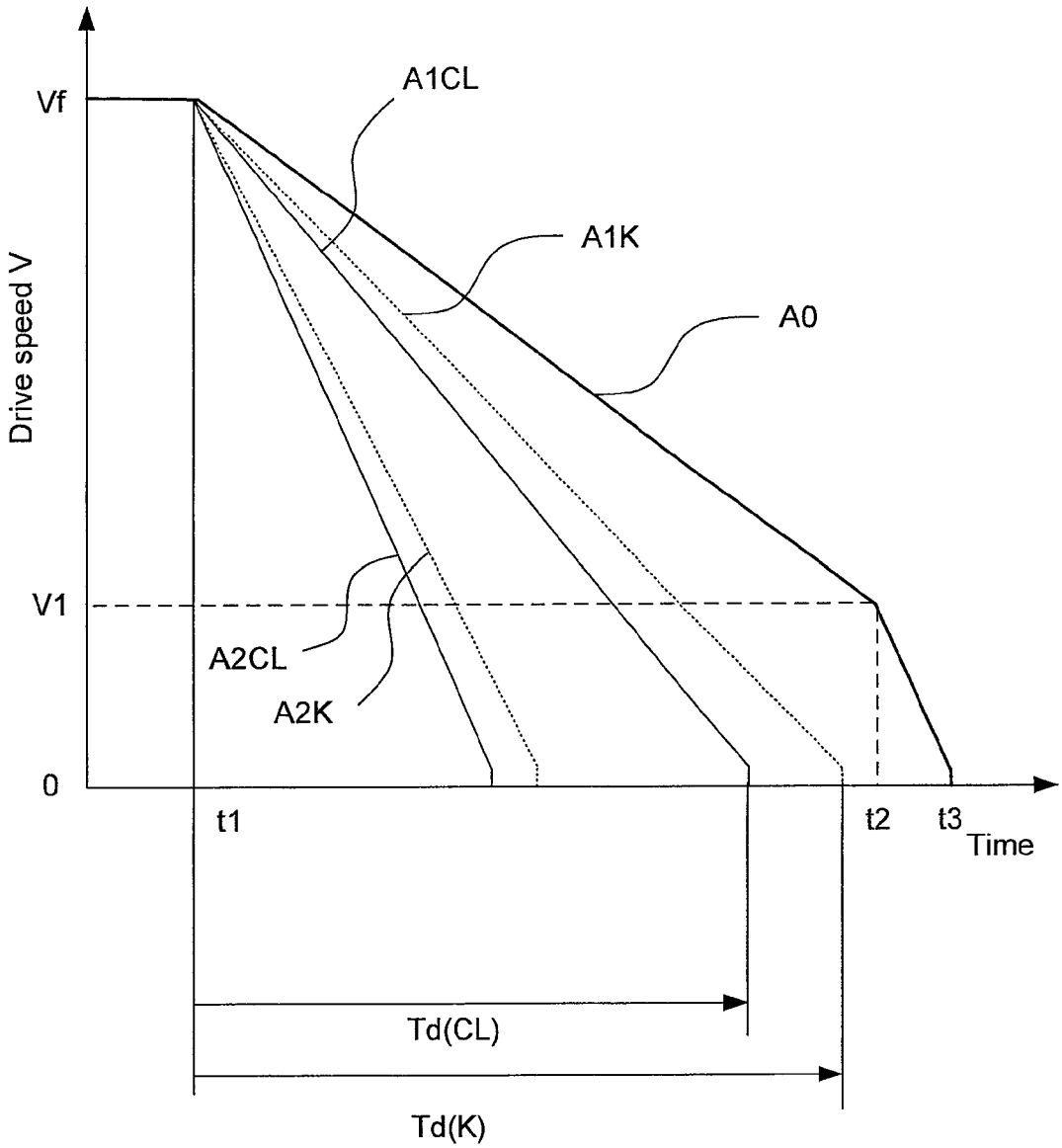
FIG. 5 is a waveform chart illustrating a waveform when a motor is stopped for the speed control according to an embodiment of the present invention.

The speed control, which is the greatest feature of the present invention, will be described next. FIG. 5 is a waveform chart illustrating the waveform when the motor for the speed control is started according to an embodiment of the present invention.

Figure 16:
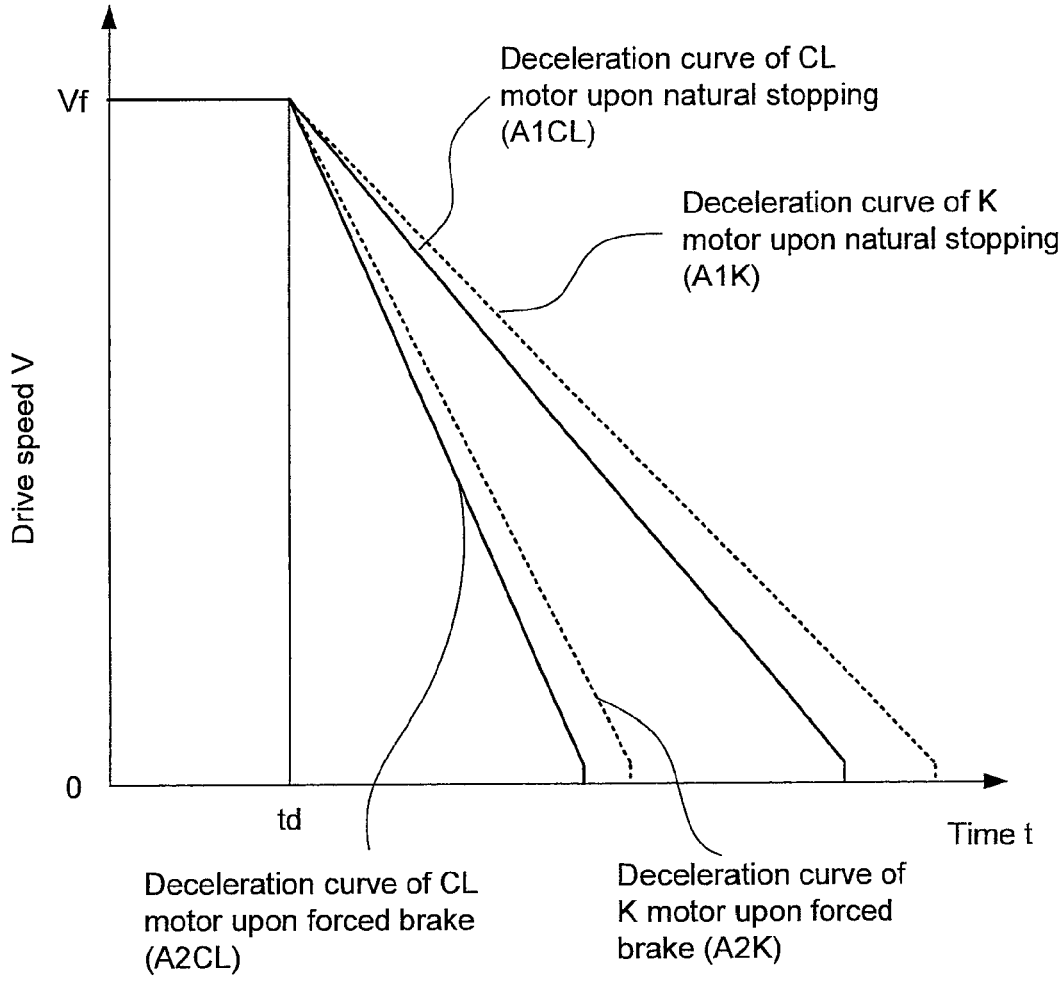
Fig.16 PRIOR ART
FIG. 16 is a waveform chart illustrating a deceleration-change characteristic when a photoconductor drum is stopped by using a DC motor as a drive source in a conventional image forming apparatus.

According to the present embodiment, when the CL motor 21 and the K motor 22 are stopped, the speed for decelerating the target value of the drive speed is set to be equal to or gentler than the deceleration-change characteristic curve A1K, which has the gentlest slope, of the deceleration-change characteristic curves in the case of naturally stopping the motors illustrated in FIG. 16. The curve A0 in FIG. 5 indicates the change of the target value in the present embodiment. The curve A0 is determined as a result of the pre-measurement of the deceleration-change characteristic in the case of naturally stopping the motors.

For comparison, FIG. 5 illustrates the deceleration-change characteristic curves A1CL, A1K, A2CL, and A2K, together with the curve A0. With this configuration, the CL motor 21 and the K motor 22 are controlled to stop along a deceleration control pattern of A0. When the drive speed is decelerated to V1, the forced brake is turned ON.

According to the present embodiment, the target speed upon the stopping drops gentler than the deceleration-change characteristic upon the natural stopping, whereby both of the CL motor 21 and the K motor 22 are decelerated without overrunning the target. Accordingly, the misregistration in the rotational phases upon the stopping is suppressed.

<Procedure of Drive Control Section>

The procedure of the drive control section 25 when the motors are stopped will be described according to the present embodiment.

Figure 6:
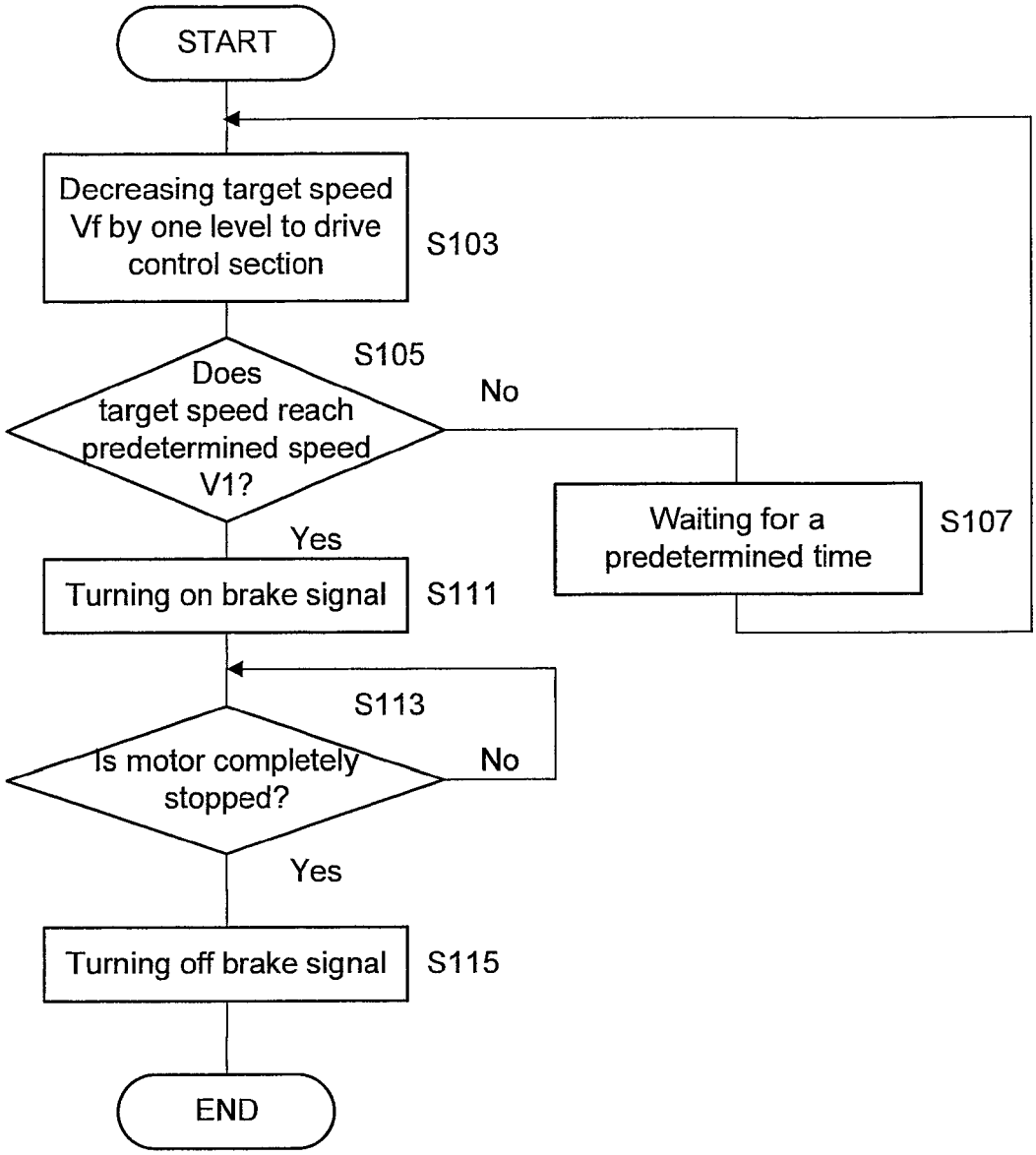
FIG. 6 is a flowchart illustrating a procedure of the drive control section when the motor is stopped in an embodiment of the present invention.

FIG. 6 is a flowchart illustrating the procedures of the drive control section 25 when the motors are stopped in the present embodiment. The procedures will be described along the flowchart.

The drive control section 25 starts a process in FIG. 6 when the time has come to stop the photoconductor drums, such as when the image formation is finished. The same process is executed to the CL motor drive control circuit 23 and the K motor drive control circuit 24, but in the description here, the CL motor drive control circuit 23 is taken as a representative.

The drive control section 25 lowers the target speed in predetermined increments with respect to the CL motor drive control circuit 23 (step S103). Then, the drive control section 25 determines whether or not the target speed reaches the speed V1 (step S105). When the target speed does not reach the speed V1, the drive control section 25 waits for a predetermined time (step S107), and then, proceeds to step S103 described above. The increments and the waiting time are set to a degree that each motor can follow the change in the target speed based on the pre-measured deceleration-change characteristic upon the natural stopping. In step S103, the drive control section 25 further decreases the target speed by predetermined increments. Afterward, the loop of step S103, S105 and S107 is repeated until the target speed reaches the speed V1. The target speed gradually decreases with a repeated process. This corresponds to a period from the time t1 to the time t2 in FIG. 5. When the target speed reaches the speed V1 as a result of the determination in step S105 (Yes in step S105), the drive control section 25 turns on the brake so as to stop the CL motor 21 with the forced brake (step S111). A period of the forced brake corresponds to a period from the time t2 to the time t3 in FIG. 5.

The drive control section 25 waits until the CL motor 21 completely stops (step S113), and then, turns off the forced brake (step S115).

<Measurement of Deceleration-Change Characteristic Upon Natural Stopping>

Next, the procedure will be explained in which the deceleration measuring section 26 naturally stops each photoconductor and measures the deceleration-change characteristic at this time, and the drive control section 25 determines the deceleration control pattern (AO in FIG. 5) of the target speed upon the stopping based on the result of the measurement (step 133).

Figure 10:
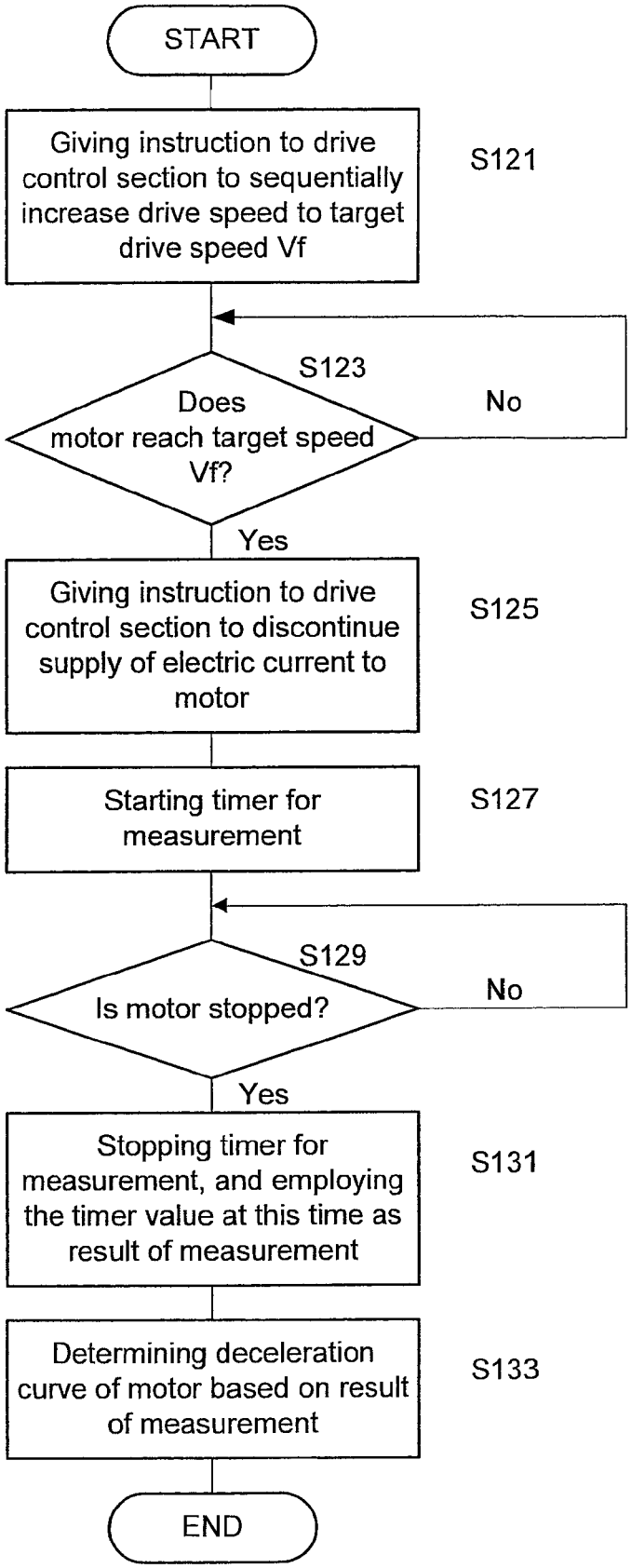
FIG. 10 is a flowchart illustrating a procedure in which the deceleration measuring section according to the present invention measures the deceleration-change characteristic of the photoconductor with the load being operated with inertia, and the drive control section determines a deceleration control pattern.

FIG. 10 is a flowchart illustrating the procedure of measuring the deceleration-change characteristic of each photoconductor and determining the deceleration control pattern based on the result of the measurement. The deceleration measuring section 26 makes the measurement in the same manner to the CL motor 21 and the K motor 22. In the description below, the measurement relating to the CL motor 21 is taken as a representative.

The deceleration measuring section 26 firstly sets the target speed to Vf to the CL motor drive control circuit 23 in order to rotate the CL motor 21 with a process speed Vf (step S121). Although the detailed description is omitted, the target speed is sequentially increased in accordance with an acceleration pattern that is set in order that the CL motor 21 can follow. After the speed of the CL motor 21 reaches the process speed Vf (step S123), the deceleration measuring section 26 gives an instruction to the CL motor drive control circuit 23 to discontinue the supply of electric current to the CL motor 21 (step S125). At the same time, a timer for the measurement is started (step S127). This corresponds to the time t1 in FIG. 5.

After the supply of electric current to the CL motor 21 is discontinued, the CL motor 21 operates for a while with inertia due to the inertial load (A1CL in FIG. 5). Then, the CL motor 21 stops after the time Td (CL) has elapsed from the time t1. The deceleration measuring section 26 monitors a speed signal outputted from the logic circuit 32 in the CL motor drive control circuit 23 (see FIG. 3), and waits until the CL motor 21 completely stops (step S129).

After the CL motor 21 stops (Yes in step S129), the deceleration measuring section 26 starts the timer for the measurement, and defines the value of the timer at this time as the result of the measurement (step S131). The value of the timer is Td (CL) in FIG. 5. The drive control section 25 determines the deceleration control pattern (A0 in FIG. 5) of the motor based on the result of the measurement.

Specifically, the drive control section 25 calculates the degree of the deceleration (A1CL) when the CL motor stops after it operates with inertia, as A1CL=Vf÷Td (CL) based on the stopping time Td (CL), and calculates the degree of the deceleration (A1K) when the K motor 22 stops after it operates with inertia, as A1K÷Td (K) based on the stopping time Td (K).

The drive control section 25 employs a smaller value of A1CL and A1K (A1K in FIG. 5) as A0. Alternatively, the drive control section 25 employs A0 in order that it takes time longer than the A1K by a predetermined time to stop the CL motor 21 and the K motor.

The increments in step S103 in FIG. 6 and the waiting time in step S107 are determined based on the characteristic of the employed A0. This is defined as the deceleration control pattern common to the CL motor and the K motor. In the present embodiment, the waiting time in step S107 is determined beforehand. The increments in step S103 are determined by multiplying the waiting time by the degree (slope) of the deceleration of the employed A0 based on the result of the measurement of the deceleration characteristic.

The deceleration measuring section 26 also makes the measurement to the K motor 22 by the same manner to the CL motor 21. The deceleration measuring section 26 compares the deceleration characteristic of the CL motor 21 and the deceleration characteristic of the K motor 22, and sets the deceleration pattern having the gentle speed decrease (taking longer time to stop) as the deceleration control pattern common to the CL motor 21 and the K motor 22. Alternatively, the deceleration characteristic obtained by prolonging the time taken to stop the motor by the predetermined time may be set as the common deceleration control pattern.

When either one of the CL motor 21 and the K motor 22 is supposed to have gentler degree of the deceleration than the other from a viewpoint of a structure of the driving mechanism, only the deceleration characteristic of the motor that gently decelerates (the K motor in FIG. 5) is measured so as to determine the deceleration control pattern A0. In this case, the deceleration characteristic of the motor that sharply decelerates (CL motor) is not measured, so that the photoconductors are prevented from being unnecessarily rotated to cause the deterioration and abrasion. The deceleration pattern is determined based on the result of the calculation of A1K.

A preferable example of a timing when the deceleration-change characteristic is measured and the deceleration control pattern is determined based on the result of the measurement is a timing when the misregistration of the rotational phases of the photoconductor drums exceeds the predetermined range. The detection of the misregistration of the rotational phases of the photoconductor drums is preferably performed during when the photoconductor drums rotate with the process speed. When the misregistration exceeds the predetermined range as a result of the detection, the deceleration-change characteristic upon the natural stopping is measured by the procedure shown in FIG. 6, when the photoconductor drums are stopped. Then, each of the photoconductor drums are stopped after they rotate, the misregistration of the rotational phases is again detected, and the misregistration is corrected, before the next full-color image is formed. The detection of the misregistration of the rotational phases and the correction thereof will be described below.

<Detection of Rotational Phase of Photoconductor Drum>

The method of detecting the rotational phases of the photoconductor drums will next be described.

FIG. 7 is an explanatory view illustrating a configuration of the sections involved with the detection of the rotational phases of the photoconductor drums in an embodiment of the present invention. Specifically, FIG. 7 shows the cyan photoconductor drum 3C, the photoconductor-drum drive gear 41C, the idle gear 43*b* that is engaged with the photoconductor-drum drive gear 41C, the C photoconductor phase sensor 27, and the projecting portion 45C corresponding to the C photoconductor phase sensor 27, those of which are viewed from a direction orthogonal to a rotational axis of the photoconductor drum 3C. As illustrated in FIG. 7, the C photoconductor phase sensor 27 that generates the C rotational phase signal in order to detect the rotational phase, is arranged so as to correspond to the photoconductor drum 3C. The projecting portion 45C is formed at a portion that rotates integral with the photoconductor drum 3C. The C photoconductor phase sensor 27 is fixed to the body. Every time the photoconductor drum 3C makes one rotation, the projecting portion 45C passes a detecting portion. In this case, the C photoconductor phase sensor 27 outputs the C rotational phase signal. A photo interrupter can be employed as the C photoconductor phase sensor 27, for example. The C rotational phase signal is inputted to the drive control section 25.

The detection of the rotational phase of the black photoconductor drum 3K is performed in the same manner.

In the present embodiment, the YMC photoconductors are adjusted in order not to produce the misregistration in the rotational phases thereof upon the manufacture. After the adjustment, the YMC photoconductors are engaged with the input gears and the idle gears, so that there is no chance that the misregistration in the phases occurs during the operation.

Accordingly, only the projecting portions formed at an end of the cyan (C) photoconductor and at an end of the black (BK) photoconductor are detected by the phase sensors, and the misregistration is corrected based on a time difference in the rotational phase signals of both phase sensors.

<Correction of Rotational Phase of Photoconductor Drum>

The procedure of correcting the rotational phases of the photoconductor drums will be described.

Figure 9:
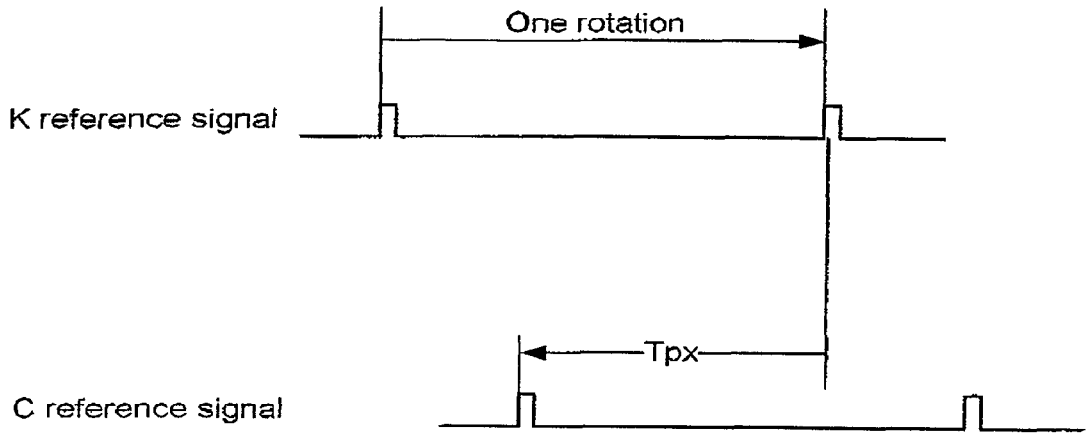
FIG. 9 is a waveform chart illustrating one example of a waveform of a rotational phase signal from a phase sensor according to an embodiment of the present invention.

Firstly, the rotational phases of the photoconductor drums 3C and 3K are adjusted to be matched during the manufacture of the apparatus. A time difference Tp0 of the rotational phase signals of the photoconductor drums 3C and 3K with the phases being matched after the adjustment is measured, and stored. In the present embodiment, the delay and the advance of the photoconductor drum 3C are stored with the photoconductor drum 3K defined as a reference. FIG. 9 is a waveform chart illustrating one example of a waveform of the rotational phase signal from the phase sensor in the present embodiment. The time Tp0 is the reference for correcting the rotational phase.

On the other hand, the time difference Tpx of the rotational phase signal of the photoconductor drum 3C and the rotational phase signal of the photoconductor drum 3K is measured during the rotation of the photoconductor drums 3 for the respective colors. The measured time difference Tpx is compared to the reference time Tp0, whereby it can be determined whether the misregistration in the phases occurs or not. If the time Tpx is deviated more than the allowable range as a result of the comparison to the time Tp0, the rotational phases of the photoconductor drums are corrected for correcting the misregistration amount □.

Figure 8A:
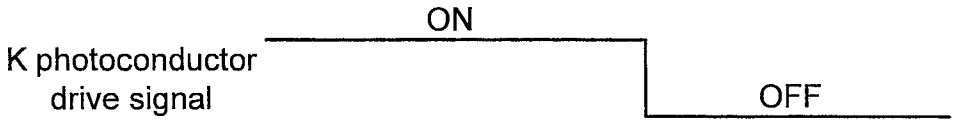
FIGS. 8A to 8C are waveform charts, each illustrating a state of correcting a misregistration in a rotational phase of a photoconductor according to the present invention.
Figure 8B:
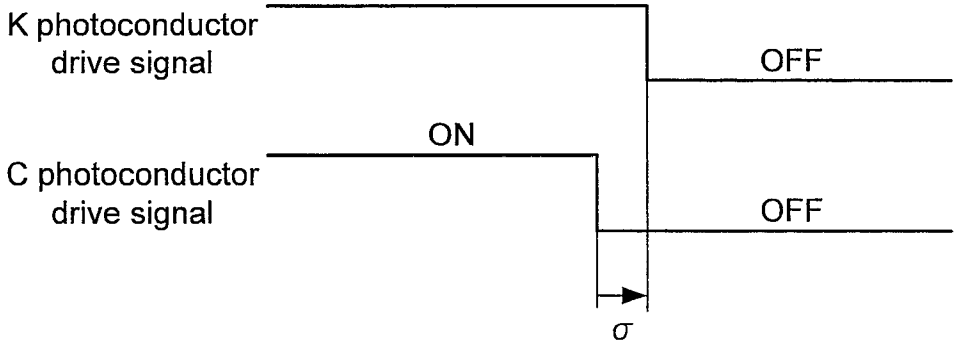
Figure 8C:
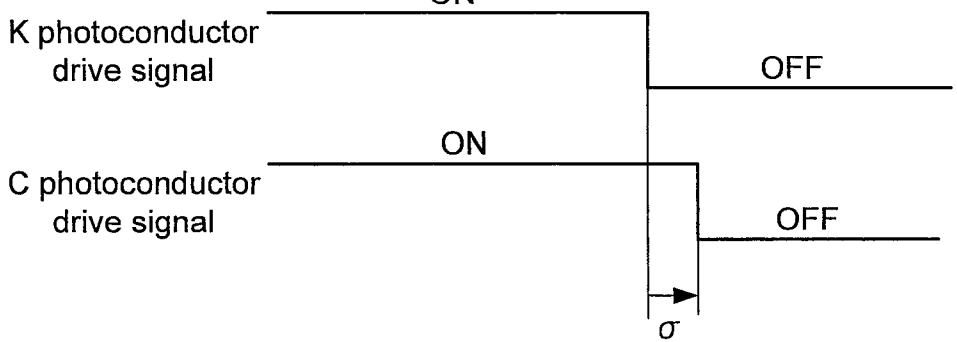

FIGS. 8A to 8C are waveform charts illustrating a state in which the misregistration in the rotational phases of the photoconductor drums is corrected.

When the phases of the photoconductor drums are matched, i.e., when a difference between the time Tpx and the time Tp0 is within a predetermined range, the drive control section 25 simultaneously stops the photoconductor drum 3K and the photoconductor drum 3C. During the normal use, both phases are matched, so that the drive control section 25 simultaneously stops both drums (see FIG. 8A).

When the black printing is performed, the black photoconductor drum 3K is stopped with the rotational phase n rotations (n is an integer) after the photoconductor drum 3K is started, whereby the black photoconductor drum 3K can be stopped without changing the relationship between the phases of the black photoconductor drum 3K and the cyan photoconductor drum 3C.

If the phase of the photoconductor drum 3C advances more than the phase of the photoconductor drum 3K from the reference by the time σ, the photoconductor drum 3C is stopped earlier than the photoconductor drum 3K by the time σ, whereby the misregistration in the rotational phases of both photoconductor drums can be corrected (FIG. 8B).

On the contrary, if the phase of the photoconductor drum 3C delays more than the phase of the photoconductor drum 3K from the reference by the time σ, the photoconductor drum 3C is stopped later than the photoconductor drum 3K by the time σ (the photoconductor drum 3C is driven too much), whereby the misregistration in the rotational phases of both photoconductor drums can be corrected (FIG. 8C).

Any one of the photoconductor drums is stopped by performing the correction of σ in the same manner n rotations (n is an integer) after it is stopped, whereby the rotational phases can be corrected.

The rotational phases are corrected in the same manner in case where the photoconductor drums 3Y, 3M, 3C, and 3K are driven by the respective independent drive sources.

Various modifications are possible for the present invention other than the aforesaid embodiment. It should not be construed that the modifications do not belong to the scope of the present invention. The present invention should include the meaning equivalent to the claims and all modifications within the scope of the present invention.

What is claimed is:

1. An image forming apparatus comprising:

a first photoconductor group constituted of one or more photoconductors used for forming a mono-color image;

a second photoconductor group constituted of one or more photoconductors used for forming a full-color image with the first photoconductor group together;

a first drive section for driving the first photoconductor group to rotate the photoconductor(s) thereof;

a second drive section for driving the second photoconductor group to rotate the photoconductor(s) thereof;

a first drive control section for controlling the first drive section;

a second drive control section for controlling the second drive section, and a deceleration measuring section for measuring respective degrees of deceleration when the first and second photoconductor groups rotate under their own inertias with a drive thereof being stopped, wherein each photoconductor constituting the first and second photoconductor groups is engaged to the corresponding drive section thereto with rotational phases being matched with one another;

the rotational phases of the first photoconductor group and the second photoconductor group are adjusted to be matched therebetween; and the first and second drive control sections determine a control pattern for decelerating both the first and second drive sections so that a degree of deceleration to be applied at a time when the first and second photoconductor groups stop rotating becomes equal to or slower than the slowest one among the degrees of deceleration measured by the deceleration measuring section.

2. The image forming apparatus according to claim 1, further comprising:

a phase detecting section for detecting the rotational phases of the first photoconductor group and the second photoconductor group; and a rotational phase correcting section for determining whether the matched rotational phases of the first and second photoconductor groups are maintained or not based on the results of the detections of the phase detecting section, and corrects the rotational phases of the first and/or the second photoconductor groups/group according to the results of the determination of the rotational phase correcting section, wherein the rotational phase correcting section detects whether the matched rotational phases are maintained or not at a predetermined timing, and allows the first and/or the second drive control sections/section to correct the rotational phase of the first and/or the second photoconductor groups/group when the rotational phase correcting section determines that the matched rotational phases are not maintained.

3. The image forming apparatus according to claim 2, wherein the rotational phase correcting section corrects the rotational phase after the deceleration measuring section measures the degrees of deceleration and before a subsequent full-color image is formed.

4. The image forming apparatus according to claim 3, wherein the rotational phase correcting section ignores the results of the detections of the phase detecting section in the period from startup of the first and second photoconductor groups to a time of their reaching the speed for image-formation and determines whether the matched rotational phases are maintained or not based on the results of the detections of the phase detecting sections after the reaching.

5. The image forming apparatus according to claim 4, wherein the deceleration measuring section starts to measure the degrees of deceleration at a time, as a trigger, when the rotational phase correcting section determines that the rotational phases are not maintained.

6. The image forming apparatus according to claim 1, wherein when the deceleration measuring section finds out beforehand which one of the first and second drive sections has slower degree of the deceleration, the deceleration measuring section measures the slower one of the deceleration, and does not measure the other.

7. The image forming apparatus according to claim 1, wherein the first drive control section controls so that a rotational phase of the first photoconductor group at a time when the first photoconductor group starts rotating matches with a rotational phase thereof at a time when it stops rotating, when a mono-color image is formed.

8. The image forming apparatus according to claim 1, wherein the first photoconductor group is constituted of a single photoconductor, while the second photoconductor group is constituted of a plurality of photoconductors.

9. The image forming apparatus according to claim 8, wherein each of the photoconductors is used for forming a toner image of a different color component, the first photoconductor group is used for forming a black toner image, and the second photoconductor group is constituted of three photoconductors used for forming a yellow toner image, a cyan toner image, and a magenta toner image, respectively.

10. The image forming apparatus according to claim 1, wherein each of the first and second drive sections includes a DC motor for driving the corresponding photoconductor group, respectively.

11. The image forming apparatus according to claim 1, further comprising:

a plurality of image forming sections for forming toner images on the photoconductors, each of the image forming sections forming an toner image on different photoconductors, wherein the first drive section drives image forming section(s) which forms/form the toner image(s) on the photoconductor(s) of the first photoconductor group and the second drive section drives image forming section(s) which forms/form the toner image(s) on the photoconductor(s) of the second photoconductor group, and each of the image forming sections includes at least a developing section.

* * * * *